US006601673B2

(12) United States Patent
Murakami et al.

(10) Patent No.: US 6,601,673 B2
(45) Date of Patent: Aug. 5, 2003

(54) SOUND ABSORBING STRUCTURE

(75) Inventors: Atsushi Murakami, Hamamatsu (JP); Takumi Arisawa, Hamamatsu (JP); Motonori Kondoh, Toyota (JP); Kazuo Nishimoto, Hamamatsu (JP); Takahiro Niwa, Minato-ku (JP)

(73) Assignee: Nichias Corporation, Tokyo (JP)

( * ) Notice: Subject to any disclaimer, the term of this patent is extended or adjusted under 35 U.S.C. 154(b) by 70 days.

(21) Appl. No.: 09/946,599

(22) Filed: Sep. 6, 2001

(65) Prior Publication Data

US 2002/0053484 A1 May 9, 2002

(30) Foreign Application Priority Data

Sep. 6, 2000 (JP) ..... P2000-270101

(51) Int. Cl.[7] ..... E04B 1/82

(52) U.S. Cl. ..... 181/293; 181/286; 181/290; 181/204; 428/304.4

(58) Field of Search ..... 181/293, 286, 181/288, 290, 291, 292, 294, 210, 204, 205; 428/304.4

(56) References Cited

U.S. PATENT DOCUMENTS

| | | | | | |
|---|---|---|---|---|---|
| 3,132,714 | A | * | 5/1964 | Gary, Jr. et al. | 181/286 |
| 4,263,356 | A | * | 4/1981 | Nomura et al. | 181/290 |
| 4,313,524 | A | * | 2/1982 | Rose | 181/291 |
| 4,441,580 | A | * | 4/1984 | Webster | 181/286 |
| 4,553,631 | A | * | 11/1985 | Panza | 181/291 |
| 4,942,080 | A | | 7/1990 | Heuel et al. | |
| 5,304,415 | A | * | 4/1994 | Kurihara et al. | 181/290 |
| 5,681,072 | A | * | 10/1997 | Stricker | 181/290 |
| 5,756,942 | A | * | 5/1998 | Tanaka et al. | 181/290 |
| 5,780,785 | A | * | 7/1998 | Eckel | 181/295 |
| 5,971,099 | A | | 10/1999 | Yasuda et al. | |

FOREIGN PATENT DOCUMENTS

| | | | |
|---|---|---|---|
| EP | 1 020 846 | 7/2000 | |
| JP | A-56-157346 | 12/1981 | B32B/3/26 |
| JP | A-56-157347 | 12/1981 | B32B/5/18 |
| JP | A-9-13943 | 1/1997 | F01N/1/24 |
| JP | 11202872 A * | 7/1999 | G10K/11/16 |

OTHER PUBLICATIONS

Patent Abstract of Japan, vol. 1997, No. 9, Sep. 30, 1997 and JP 09 134179 A (Isuzu Motors Ltd).

Patent Abstract of Japan, vol. 1999, No. 14, Dec. 22, 1999 and JP 11 242486 A (Isuzu Motors Ltd.).

Patent Abstract of Japan, vol. 2000, No. 5, Sep. 14, 2000 and JP 2000 034938 A (Mitsubishi Motors Corp.).

* cited by examiner

*Primary Examiner*—Bentsu Ro
*Assistant Examiner*—Edgardo San Martin
(74) *Attorney, Agent, or Firm*—Nixon & Vanderhye P.C.

(57) ABSTRACT

A sound absorbing structure including a film with through holes formed is laminated on a porous member having communicating voids on the side facing a sound source. At least one of the through holes has an opening area of 19 $mm^2$ or more, and the total of the opening area accounts for 1 to 70% with respect to the area of a film formation surface on the porous member. A soundproof cover including the sound absorbing structure disposed on the inner surface of a cover main body are also provided.

8 Claims, 14 Drawing Sheets

SOUND ABSORBING STRUCTURE

BACKGROUND OF THE INVENTION

1. Field of the Invention

The present invention relates to a sound absorbing structure comprising a porous member and a film having through holes laminated. In particular, it relates to a sound absorbing structure to be used for a soundproof cover.

2. Description of the Related Art

It is generally known that a porous member having communicating voids, such as a fibrous compact and an open cell foam material has a good sound absorbing characteristic. Therefore, it is used for the sound absorbing treatment for the inside of an engine cover or the inside of a bonnet of an automobile for the purpose of reduction of the noise from the automobile. However, according to the porous member, the sound absorbing material needs to be thick for improvement of the sound absorption coefficient in the middle or low sound range whereas in many cases a thick sound absorbing material cannot be installed due to the space limitation inside the engine cover or the bonnet. Therefore, a problem is involved in that a sufficient sound absorbing effect cannot be obtained by the sound absorbing material comprising the conventional porous member having the communicating voids.

Moreover, a foam material having a mixed cell structure of open cells and closed cells, and an open cell urethane foam with a film are also used as a sound absorbing material. However, although the foam material has a sound absorption peak at a relatively low frequency side, the peak value itself is not sufficiently high. Moreover, a thicker one has the peak shifted to the low frequency side, but since the frequency range of the peak itself is narrow, a sound absorbing effect may be obtained to some extent with respect to only a sound source with a specific single frequency or a frequency in the vicinity thereof by using a material with a thickness corresponding to the frequency. However, for example, in the case of the inside of an engine cover or the inside of a bonnet, due to the structure limitation, the foam material thickness cannot be changed freely in most cases. Moreover, since the automobile engine room noise in general has a frequency range to some extent, a sufficient sound absorbing effect cannot be obtained by the foam material having a mixed cell structure having a narrow sound absorption coefficient peak frequency range, with the peak frequency dependent on the thickness.

Moreover, a foam material having a cell structure with only closed cell is also used, but it has a low sound absorption coefficient in the entire frequency range so that it hardly provides the sound absorbing effect.

Furthermore, a perforated board as a resonant sound absorbing structure, comprising a hard board with through holes having an air layer on the back side is also used. Although an ordinary perforated board has a relatively high sound absorbing characteristic in a single frequency range, it shows only a low sound absorbing characteristic as a whole. It is known that the sound absorbing characteristic can be improved by disposing a urethane open cell foam or a glass wool in the perforated board back side air layer, but the sound absorbing characteristic is not sufficient.

For example, JP-A-9-13943 discloses a sound absorbing structure as a combination of a sound absorbing base material and a perforated cover material. JP-A-56-157347 discloses a sound absorbing structure as a combination of a foam material and a perforated film. JP-A-56-157346 discloses a sound absorbing structure as a combination of a porous material and a soft resin sheet provided with an air chamber. However, these sound absorbing structures show a high sound absorbing effect only in a specific frequency range. Therefore, a problem is involved in that although the noise can be reduced only when the frequency range of the noise actually shed and the frequency range whereat the sound absorbing effect can be provided coincide, the noise cannot be reduced in most cases. Moreover, the sound absorbing structure should be thick in order to improve the sound absorbing effect of these sound absorbing structures so that in the case a thick sound absorbing structure cannot be installed owing to the space limitation, the noise reduction effect can be further lowered. Particularly in the case of the sound absorbing structure disclosed in JP-A-9-13943, a problem arises in that the sound absorption coefficient on the low frequency side is low.

SUMMARY OF THE INVENTION

The invention has been achieved in view of the circumstances, and an object thereof is to provide a sound absorbing structure and a soundproof cover having a good sound absorbing characteristic in a wide frequency range, capable of further improving the sound absorbing characteristic in a desired frequency range according to the purpose.

As a result of the elaborate discussion of the present inventors, it was found out that the sound absorbing characteristic in a desired frequency range can be improved easily by providing a film on at least one side of a porous member having communicating voids, and further providing through holes in the film so that the sound absorbing characteristic thereof can be controlled optionally, and that a high sound absorbing characteristic can be provided in a wide frequency range by laminating the sound absorbing structures so that the same or more sound absorbing characteristic can be provided by a half or less thickness with respect to the conventional sound absorbing materials comprising a foam material or a fibrous compact. Moreover, it was found out that the sound absorption coefficient on the low frequency side can be improved in the case where at least one of the through holes has an opening area of 19 $mm^2$ or more, and the total of the opening area of the through holes accounts for 1 to 70% with respect to the area of a film formation surface of the porous member. Furthermore, it was found out that a soundproof cover having the excellent noise insulation performance can be provided by mounting such a sound absorbing structure on a cover main body. The invention is based on the knowledge.

That is, in order to achieve the objects, the invention provides a sound absorbing structure comprising a film with through holes formed, laminated on a porous member having communicating voids at least on the side facing a sound source, wherein at least one of the through holes has an opening area of 19 $mm^2$ or more, and the total of the opening area accounts for 1 to 70% with respect to the area of the film formation surface of the porous member (hereinafter referred to as a "first sound absorbing structure").

Moreover, the invention provides a sound absorbing structure comprising a structure having a film without a hole laminated on at least one surface of a porous member having communicating voids as a lower layer, and the first sound absorbing structure as an upper layer, with both films laminated so as to face a sound source (hereinafter referred to as a "second sound absorbing structure").

Furthermore, the invention provides a sound absorbing structure comprising two or more layers of the first sound absorbing structures, with the film having the through holes of each sound absorbing structure facing a sound source, laminated such that the total of the opening area of the through holes is successively reduced with that of the sound absorbing structure disposed closest to the sound source maximum and that of the sound absorbing structure disposed farthest to the sound source minimum (hereinafter referred to as a "third sound absorbing structure").

Still further, the invention provides a soundproof cover comprising the first to third sound absorbing structures disposed on the inner surface of a cover main body.

DETAILED DESCRIPTION OF THE PREFERRED EMBODIMENTS

Hereinafter, the invention will be explained in detail.

First Sound Absorbing Structure

Figure 1:
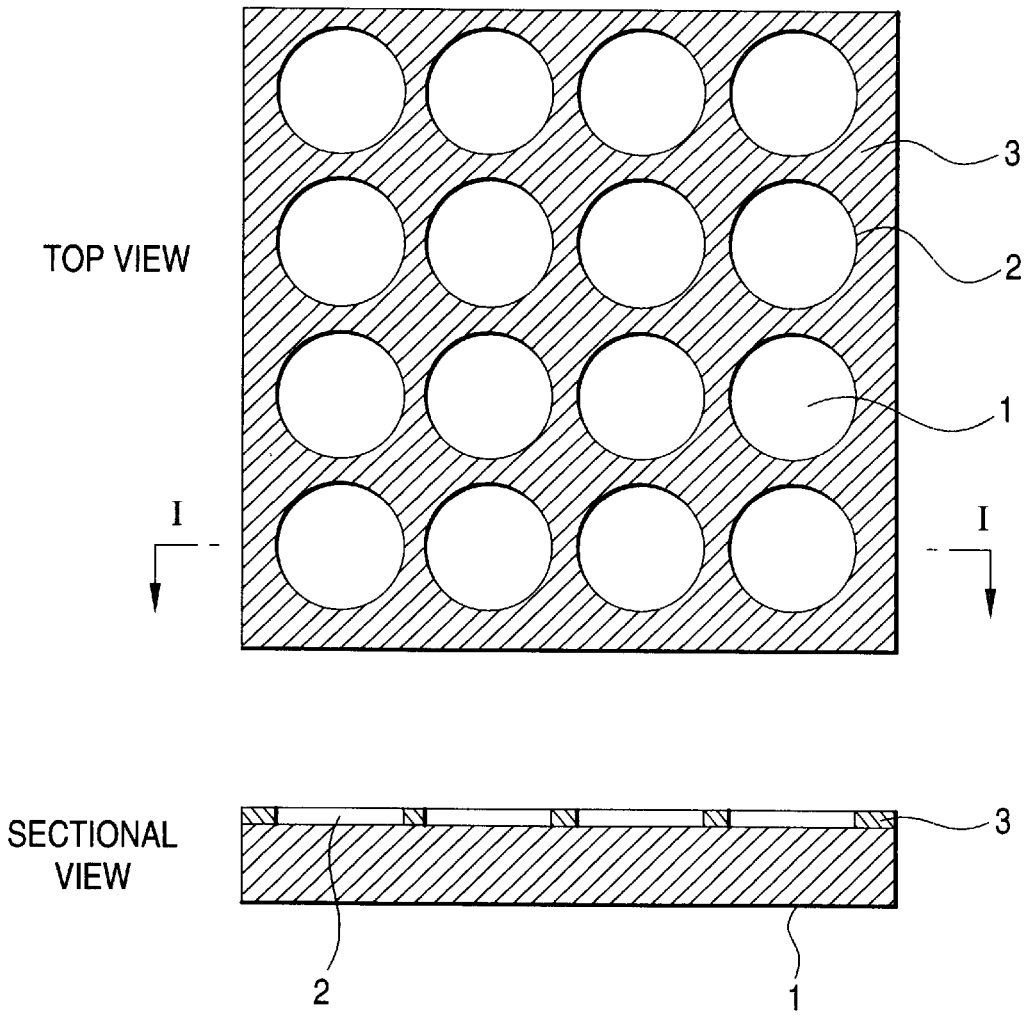
FIG. 1 is a top view and a I—I sectional view of an embodiment of a first sound absorbing structure of the invention.

A first sound absorbing structure according to the invention is produced by laminating a film 3 with a plurality of through holes 2 formed, laminated at least on one side of a porous member 1 having communicating voids as shown in FIG. 1. The first sound absorbing structure is disposed such that the film 3 faces a sound source at the time of use. Moreover, the sound source is disposed upward in a I—I sectional view of FIG. 1. The same is applied to the second sound absorbing structure and the third sound absorbing structure described later.

As the porous member 1, a fibrous compact and an open cell foam can be provided, but it is not limited thereto. In the case where the fibrous compact is used as the porous member 1, various fibrous materials such as an organic fiber and an inorganic fiber can be used as the main component thereof. Specifically, for example, organic fiber compacts such as a polyester felt, a cotton felt, and a nylon fiber non-woven fabric, and inorganic fiber compacts such as a glass wool and a rock wool can be presented, but it is not limited thereto. In particular, since the inorganic fiber compacts have the excellent heat resistance, they are preferable as a sound absorbing material for a soundproof cover, such as an engine cover, to be exposed to a relatively high temperature. Moreover, as such a fibrous compact, a glass wool commercially available as a sound absorbing material or a thermal insulation material for the construction can be used as well.

In the case where the open cell foam is used as the porous member 1, the water absorption coefficient of the foam material to be used is preferably 0.2 g/cm$^3$ or more, more preferably 0.3 g/cm$^3$ or more, further preferably 0.4 g/cm$^3$ or more. By using a foam material with the water absorption coefficient, a sound absorbing structure having a good sound absorbing characteristic can be obtained. The water absorption coefficient is measured by the JIS K6767 B method.

Moreover, as the main component of the foam material, various kinds of polymer materials, such as a rubber, an elastomer, a thermoplastic resin, and a thermosetting resin can be used. As the polymer materials, various rubbers such as a natural rubber, a CR (chloroprene rubber), an SBR (styrene butadiene rubber), an NBR (nitrile-butadiene rubber), an EPDM (ethylene-propylene-diene three element copolymer), a silicone rubber, a silicone rubber, a fluoride rubber, and an acrylic rubber, elastomers such as a thermoplastic elastomer, and a soft urethane, thermoplastic resins such as a polyethylene, a polypropylene, a polyamide, and a polyester, and various thermosetting resins such as a hard urethane, and a phenolic resin can be presented, but it is not limited thereto. Since a foam material containing a soft urethane as the main component is inexpensive and has a high strength, it is particularly preferable for a soundproof cover. Moreover, as the foam material, for example, a soft urethane foam material sheet commercially available as a cushion material can be used as well.

As the main component of the film 3, various kinds of inorganic fibrous woven fabrics, various kinds of inorganic fibrous non-woven fabrics, various kinds of organic fibrous woven fabrics, various kinds of organic fibrous non-woven fabrics, various kinds of thermoplastic resin films, various kinds of thermosetting resin films, metal foils, or the like can be used. As the inorganic fibrous woven fabrics or the inorganic fibrous non-woven fabrics, for example, a glass cloth, a ceramic fiber cloth, a metal cloth or the like, can be presented. As the organic fibrous woven fabrics or the organic fibrous non-woven fabrics, for example, a nylon cloth, a polyester cloth, a cotton cloth, an acrylic fiber cloth, a urethane fiber cloth, a polypropylene fiber cloth, or the like, can be presented. As the resin films, for example, a polyethylene film, a polypropylene film, a polyester film, a polyvinyl chloride film, a polyamide film, a polyurethane film, an ethylene vinyl acetate copolymer film, or the like, can be presented. As the metal foils, for example, an aluminum foil, a copper foil, a gold foil, a silver foil, or the like, can be presented. Particularly in the case where the inorganic fibrous woven fabric or the inorganic fibrous non-woven fabric is used as the material for the film 3, since it has a good heat resistance, it is particularly preferable as a sound absorbing structure for a soundproof cover to be exposed to a relatively high temperature, such as an engine cover. These are just some embodiments of the main component of the film 3 material, and thus the film 3 material is not limited thereto.

Moreover, it is preferable that the film 3 is made of a material with a low ventilation ratio. The ventilation ratio can be calculated from the ventilation amount at the time of a 125 Pa differential pressure defined in the A method of JIS L1096 "general textile testing method". In the invention, the ventilation ratio of the material to be used is preferably 10 $cm^3/cm^2/sec$ or less, more preferably 5 $cm^3/cm^2/sec$ or less, further preferably 1 $cm^3/cm^2/sec$ or less. By using a film 3 made of a material having the ventilation ratio in the range, a sound absorbing structure having a good sound absorbing characteristic can be provided.

In the case where a fibrous woven fabric or a fibrous non-woven fabric is used as the material of the film 3, one having a fine network, that is, one having a large number of fibers per unit area is preferable. With a fibrous woven fabric or a fibrous non-woven fabric having a fine network, since there are little voids therein, the ventilation ratio can be small so that a sound absorbing structure having a good sound absorbing characteristic can be obtained. Moreover, in the case of the woven fabric, one produced by a plain weaving method is preferable. Particularly in the case of a fibrous woven fabric with fine network made by plain weaving has a low ventilation ratio, a sound absorbing structure having a good sound absorbing characteristic can be obtained. Furthermore, by using a glass cloth having a fine network made by plain weaving, a sound absorbing structure having a good sound absorbing characteristic can be obtained.

At least one of the plurality of the through holes 2 formed in the film 3 has 19 $mm^2$ or more of an opening area. In the case where the opening area of the through holes 2 is smaller than 19 $mm^2$, the sound absorption coefficient on the low frequency side is made lower. Moreover, in the case where the ratio of the opening area of the through holes 2 is too small with respect to the area of the surface of the porous member 1 with the film 3 formed, a sufficiently high sound absorbing characteristic cannot be provided. In contrast, in the case where it is too large, the sound absorption coefficient is lower than the case of not providing the through holes 2. Therefore, in the invention, the ratio of the through holes 2 is preferably a value in a specific range. It is preferably 1% or more and 70% or less, more preferably 3% or more and 50% or less, and further preferably 5% or more and 40% or less. By having the total of the opening area of the through holes 2, the sound absorbing characteristic of the sound absorbing structure can be improved significantly.

The size, the shape and the arrangement of the through holes 2 provided in the film 3 is not particularly limited as long as the above-mentioned conditions are satisfied, but, for example, as shown in FIG. 1, the through holes 2 can be provided in a round shape of the same size on the intersections of a lattice with the equal interval. At the time, by making the diameter of the through holes 2 larger, or making the number of the through holes 3 per unit area larger, that is, by narrowing the lattice interval, the sound absorption coefficient on the high frequency side can be improved. In contrast, by making the diameter of the through holes 2 smaller, or making the number of the through holes 2 per unit area smaller, that is, by enlarging the lattice interval, the sound absorption coefficient on the low frequency side can be improved. Therefore, in order to improve the sound absorption coefficient at a targeted frequency range, the size of the through holes 2 or the interval of the lattice can be set at an appropriate value.

Moreover, in the case where the size and the arrangement of the through holes 2 are constant, with a thicker thickness of the entire sound absorbing structure (porous member 1+film 3), the sound absorption coefficient on the low frequency side can be improved. In contrast, with a thinner thickness, the sound absorption coefficient on the high frequency side can be improved. Therefore, according to the thickness of the entire sound absorbing structure, the frequency whereat the sound absorbing effect is significant differs. However, by optionally changing the size, the shape, and the arrangement of the through holes 2, the sound absorption coefficient of the frequency in a certain range can be improved, and thus the noise level of a desired frequency range can be made lower.

Furthermore, in the case where the size and the arrangement of the through holes 2 are constant, with a large surface density of the film 3, that is, with a large weight of the film 3 per unit area, the sound absorption coefficient on the low frequency side can be improved. In contrast, with a small surface density, the sound absorption coefficient on the high frequency side can be improved. Therefore, according to the surface density of the film 3, the frequency whereat the sound absorbing effect is significant differs. However, by optionally changing the size, the shape, and the arrangement of the through holes 2, the sound absorption coefficient of the frequency in a certain range can be improved, and thus the noise level of a desired frequency range can be made lower.

As heretofore mentioned, according to the sound absorbing structure of the invention, the sound absorbing characteristic at a specific frequency range can be improved easily.

According to the first sound absorbing structure, a sound absorbing structure using a glass wool or rock wool compact as the material of the porous member 1, and a glass cloth as the material of the film 3 is preferable as a sound absorbing material for a soundproof cover since both the film 3 and the porous member 1 have the excellent heat resistance and a good sound absorbing characteristic, and can be provided relatively inexpensively. Furthermore, by using an ethyl silicate and/or a colloidal silica and/or a water glass having a high heat resistance as a binder for the glass wool or the rock wool, the heat resistance of the sound absorbing structure can further be made higher.

The first sound absorbing structure is not limited by a specific theory, but the inventors consider as follows. That is, as the structural feature of the sound absorbing structure, it has a structure similar to that of a film vibration type sound absorbing structure comprising an air layer behind a soft film-like substance such as a resin film, and the sound absorption peak behavior coincides with a formula representing the film vibration sound absorption peak frequency. Therefore, it is considered that the sound absorbing mechanism includes the film vibration function. That is, the film vibration is the first sound absorbing mechanism.

Moreover, since the film 3 provided with the through holes 2 is disposed on the sound source side in the sound absorbing structure, a sound wave passed through the through holes 2 is directly incident on the porous member 1 disposed on the rear side. Here, since the porous member 1 is an ordinarily used sound absorbing material, the sound wave incident on the porous member 1 is attenuated. That is, the attenuation inside the porous member 1 of the sound wave incident on the porous member 1 is the second sound absorbing mechanism.

Furthermore, the sound wave incident on the porous member 1 via the through holes 2 mentioned above is attenuated to some extent in the inside of the porous member 1, but it is not attenuated completely. The remaining sound wave not attenuated is further reflected by a rigid wall (a cover main body of the soundproof cover or a mounted wall surface) on the rear side so as to be discharged to the outside of the sound absorbing structure again via the through holes 2. Moreover, the sound wave incident on a portion of the film 3 without the through holes 2 is discharged to the sound source side by the sound wave reflection generated to some extent on the surface of the film 3. Therefore, the sound wave incident via the through holes 2 and reflected by the rigid wall and the sound wave reflected by the portion of the film 3 other than the through holes 2 interfere so as to offset with each other and absorb the sound by a specific frequency dependent on each sound strength and the thickness from the film 3 to the rigid wall, that is, the thickness of the porous member 1. That is, the interference of the reflected waves from the rigid wall and the film 3 surface is the third sound absorbing mechanism.

Moreover, the sound absorbing structure has a structure similar to that of a resonance type sound absorbing structure comprising a perforated board with an air layer or a porous member disposed behind a hard board provided with through holes. Therefore resonance applied on the perforated board, or the like is considered to serve as a sound absorbing mechanism. That is, the resonance similar to the perforated board is the fourth sound absorbing mechanism.

Accordingly, the sound absorbing structure is considered to have a sound absorbing characteristic superior to that of a commonly used sound absorbing material owing to the multiplier effect of the four sound absorbing mechanisms.

Furthermore, it is known that a film vibration type sound absorbing structure shows the sound absorption peak at a specific frequency. The sound absorption peak varies depending on the film surface density, that is, the weight per unit area and the thickness of an air layer on a rear side. The sound absorption peak frequency is represented by the following formula:

[Formula 1]

$$f = \frac{60}{\sqrt{mL}}$$

f: sound absorption frequency (Hz), m: film surface density (kg/m$^2$),

L: thickness of an air layer on a back side (m)

In the sound absorbing structure, the thickness of the porous member 1 corresponds to the air layer thickness of the film vibration type sound absorbing structure, and the surface density of the film 3 in the state provided with the through holes 2 corresponds to the air layer thickness of the film vibration type sound absorbing structure. According to the formula, in the case where the film surface density is lowered, the sound absorption peak is shifted to the high frequency side. In the sound absorbing structure, the sound absorption peak is shifted to the high frequency side according to enlargement of the opening area ratio of the through holes 2 provided in the film 3. That is, the cause of the shift of the sound absorption peak by the through holes 2 provided in the film 3 in the sound absorbing structure is considered to the change of the portion corresponding to the surface density of the film of the film vibration type structure. Therefore, by changing the opening area ratio of the through holes 2 provided in the film 3, the sound absorption coefficient of a specific frequency can be made higher.

In the case where a material with a high ventilation ratio is used as the material of the film 3, since the film vibration is not limited even in the case where a sound wave, which is a compression wave of the air, is incident, the sound absorption coefficient is not improved significantly. However since the film vibration is generated in the material with a low ventilation ratio, the sound absorbing characteristic is improved, and furthermore, the sound absorbing characteristic can be controlled according to the opening area ratio of the through holes 2 in the film 3.

Moreover, in the case where the film vibration is observed as one of the sound absorbing mechanisms, the material of the film 3 is preferably one having the appropriate and well balanced flexibility, rigidity, and weight. In the invention, a large improvement of the sound absorbing characteristic can be provided in the case where a glass cloth is used. The inventors regard that this is because the glass cloth has the appropriate and well balanced flexibility, rigidity, and weight.

Although a film vibration type sound absorbing structure using an ordinary resin film not provided with through holes in a film shows a slightly high sound absorbing characteristic in a single frequency range, it only shows a low sound absorbing characteristic as a whole. It is known that the sound absorbing characteristic can be improved by disposing an open cell foam such as a soft urethane, or a glass wool in the back side air layer of the film-like substance in the film vibration type sound absorbing structure, but the sound absorbing characteristic is not sufficient. The sound absorbing structure shows an extremely high sound absorbing characteristic compared with the film vibration type sound absorbing structure using an ordinary resin film, a foam material single body, or a fibrous compact single body. This is an unexpected phenomenon.

Figure 2:
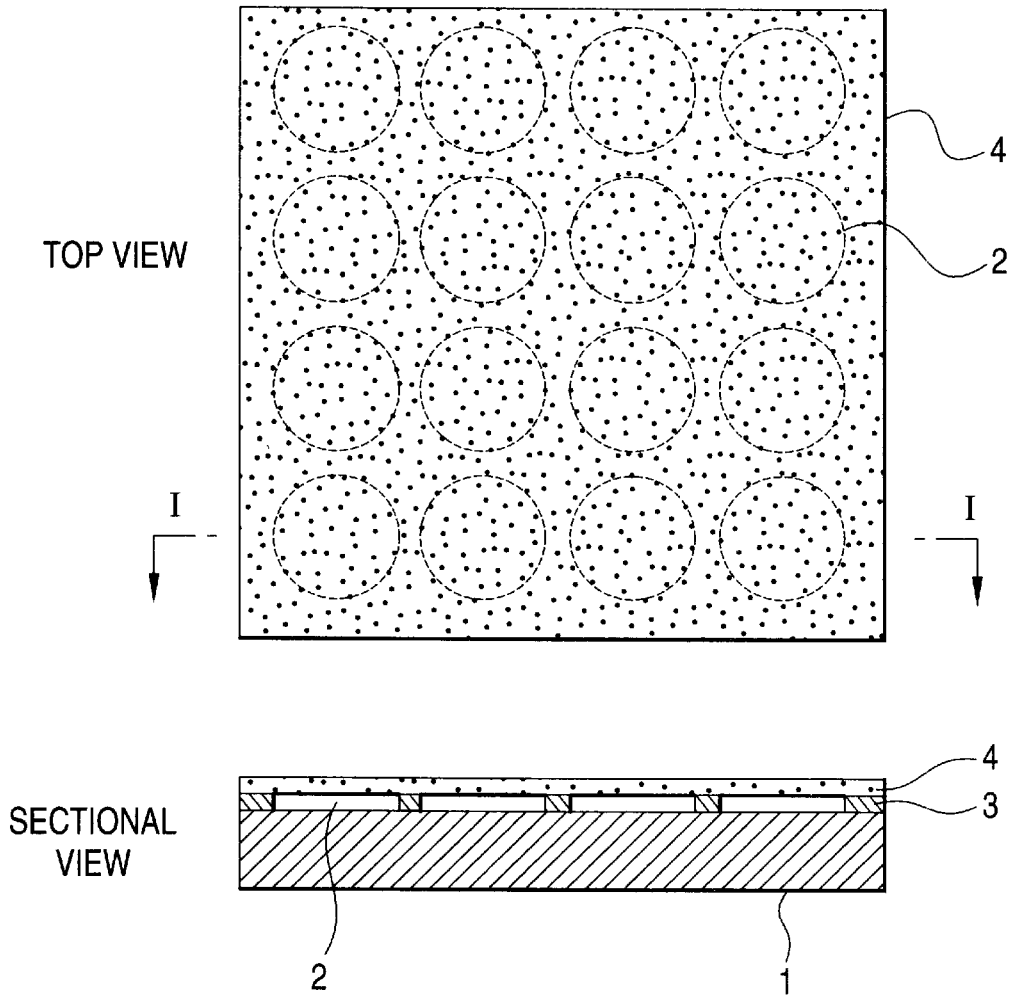
FIG. 2 is a top view and a I—I sectional view of another embodiment of the first sound absorbing structure.

In the first sound absorbing structure, it is also possible to dispose a film without a hole 4 without the through hole formation on the further outside of the film 3 as shown in FIG. 2 for preventing the direct exposure of the porous member 1 to the outside via the through holes 2 of the film 3. At the time, the film without a hole 4 should not deteriorate the sound absorbing characteristic of the first sound absorbing structure according to the film 3 and the back side porous member 1. In particular, in the case where the ventilation ratio of the film without a hole 4 is low, since a sound wave cannot be incident on the first sound absorbing structure sufficiently, the sound absorbing characteristic as the entirety of the sound absorbing structure including the film without a hole 4 is lowered. In contrast, in the case where the ventilation ratio of the film without a hole 4 is high, since a sound wave is incident on the first absorbing structure sufficiently, the sound absorbing characteristic can be maintained as the entirety of the sound absorbing structure including the film without a hole 4. Therefore, as the material of the film without a hole 4, one having a high ventilation ratio, specifically, of a 100 $cm^3/cm^2/sec$ or more, in particular, of a 200 $cm^3/cm^2/sec$ or more, is preferable. Thereby, a sound absorbing structure having a good sound absorbing characteristic can be obtained.

Moreover, in the case where a fibrous woven fabric or a fibrous non-woven fabric is used as the material of the film without a hole 4, one having a rough network, that is, one having a small number of fibers per unit area is preferable. With a fibrous woven fabric or a fibrous non-woven fabric having a rough network, there are many voids therein, and the ventilation ratio can be large so that a sound absorbing structure having a good sound absorbing characteristic can be obtained.

In the description, in the case where the film 3, and further, the film without a hole 4 are provided integrally with the porous member 1, various means such as an adhesive, a bond, a bonding tape, and a hot melt adhesive film can be used. Moreover, it is also possible to use means such as stapling, and stitching, but the integration method is not limited thereto.

Second Sound Absorbing Structure

Figure 3:
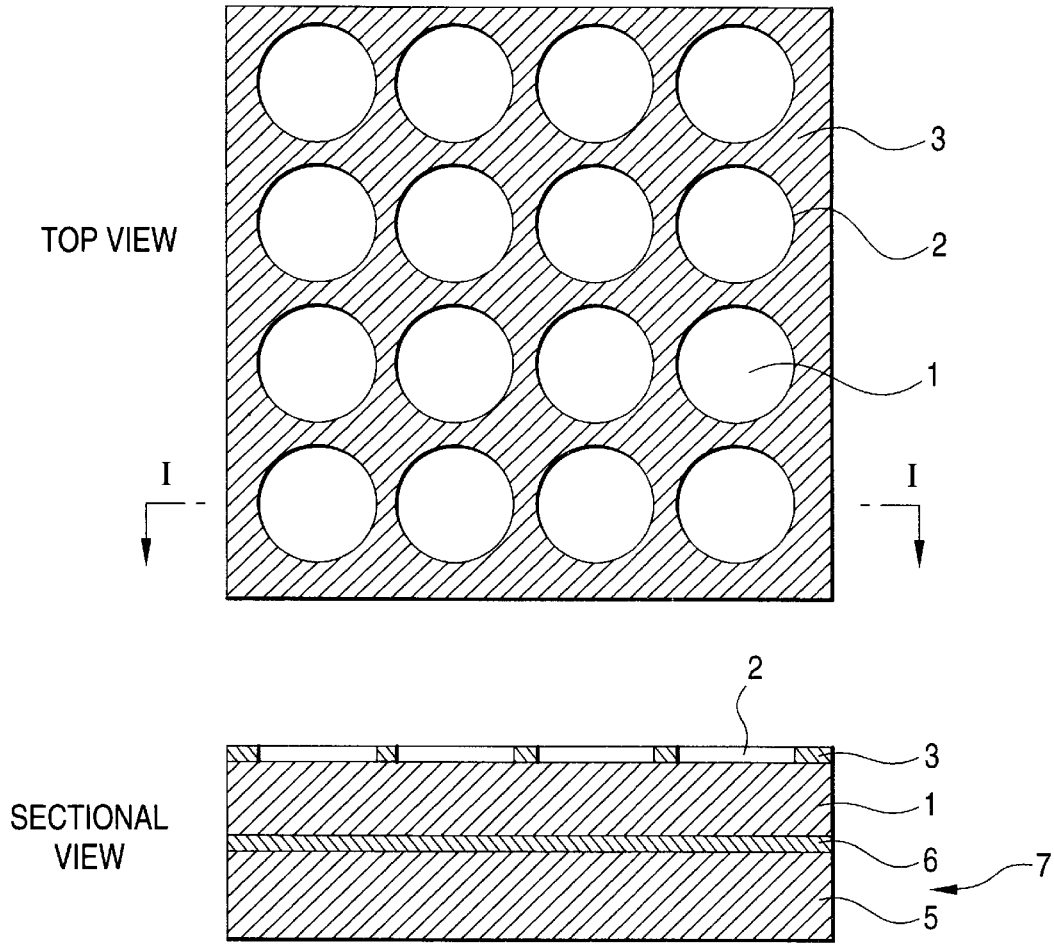
FIG. 3 is a top view and a I—I sectional view of an embodiment of a second sound absorbing structure of the invention.

A second sound absorbing structure according to the invention is produced by laminating on at least one side of a porous member 5 having communicating voids, a structure 7 with a film without a hole 6 without the through hole formation as a lower layer, and the first sound absorbing structure as an upper layer as shown in FIG. 3. The porous member 5 and the film without a hole 6 of the structure 7 can be made of the same materials as those of the porous member 1 and the film 3 of the first sound absorbing structure. Moreover, as to the lamination method, as shown in the figure, the film without a hole 6 of the structure 7 and the film 3 of the first sound absorbing structure are laminated so as to have both of them facing a sound source.

Third Sound Absorbing Structure

Figure 4:
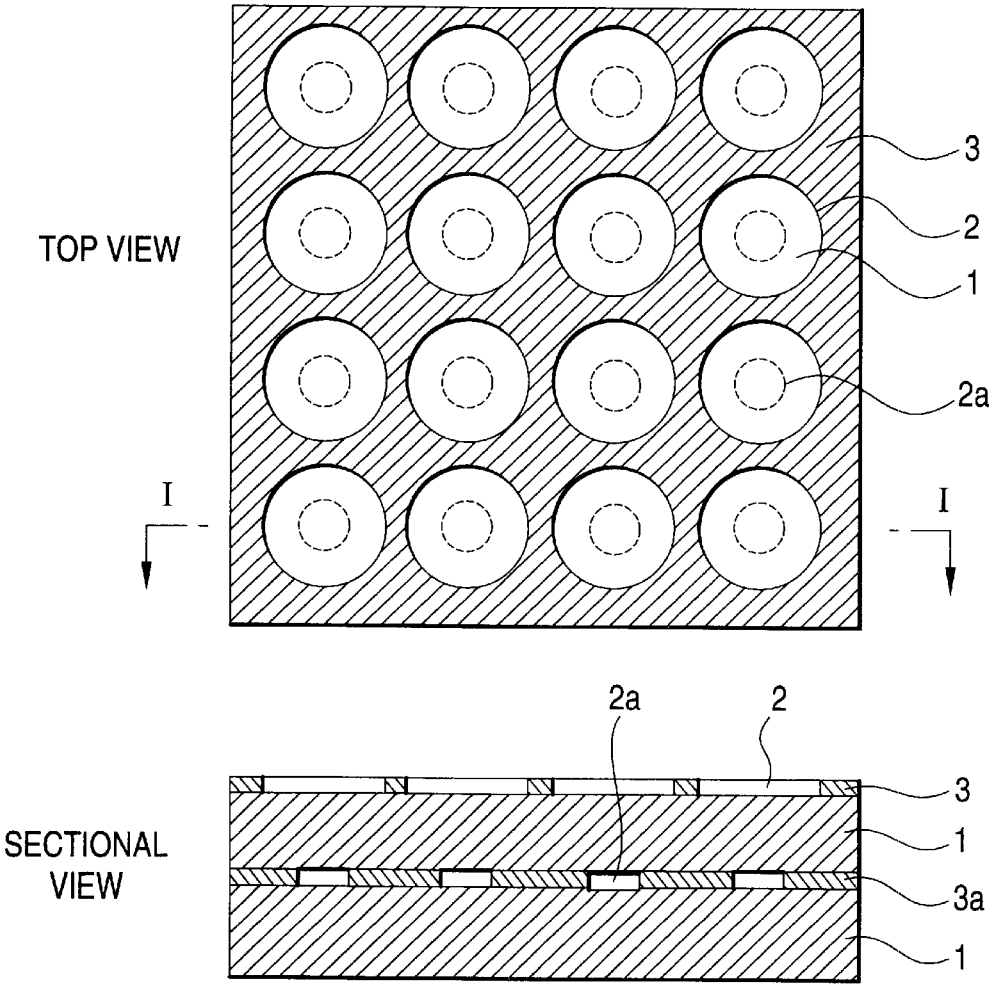
FIG. 4 is a top view and a I—I sectional view of an embodiment of a third sound absorbing structure of the invention.

A third sound absorbing structure according to the invention is produced by laminating two or more layers of the first sound absorbing structures such that the film having the through holes in each layer faces a sound source as shown in FIG. 4. At the time, they are laminated such that the total of the opening area in each layer is successively reduced with the total of the opening area of the through holes 2 formed in the film 3 of the sound absorbing structure disposed closest to the sound source (here, the upper layer) maximum and the total of the opening area of the through holes 2*a* formed in the film 3 of the sound absorbing structure disposed farthest to the sound source (here, the lower layer) minimum. Moreover, it is preferable that the through holes 2, 2*a* of the layers are superimposed concentrically as shown in the figure.

According to the second and third sound absorbing structures, by providing a laminated structure, the sound absorbing characteristic can be improved further in a wide frequency range. The inventors assume the function as follows. That is, a porous member having a film provided with through holes in one layer improves the sound absorbing characteristic of a single frequency. Therefore, by using a plurality of porous members having films provided with through holes of different sizes and/or positions, with different frequency characteristics, and laminating the same so as to provide a sound absorbing structure as a whole, the sound absorbing frequencies of each layer are superimposed so that the sound absorbing characteristic can be improved over a wide frequency range as a whole.

Although a configuration provided with the film having the through holes formed on one side (sound source side) of the porous member has been described in the first sound absorbing structure to the third sound absorbing structure, the film having the through holes formed may be provided on both sides of the porous member. Moreover, in the second sound absorbing structure and the third sound absorbing structure, the materials of the porous member and the film, and further, the thickness may be same in all the layers, or different in each layer. In the latter case, a further various sound absorbing characteristic can be obtained.

By disposing the sound absorbing structure according to the invention on the inner surface (sound source side) of a soundproof cover, a soundproof cover capable of optionally controlling the frequency band at which the noise insulation effect is provided, can be provided. The invention includes the soundproof cover.

As the material of a cover main body of the soundproof cover, various kinds of metals such as an iron, an aluminum, and a stainless steel, and various resins such as a nylon, a polypropylene, and an unsaturated polyester can be used. Moreover, it is also possible to add a filler and/or a fiber to each resin. In particular, since a material produced by adding a filler and/or a fiber to a nylon has a light weight, and the excellent heat resistance and strength characteristic, it is preferable as the cover main body.

Figure 5:
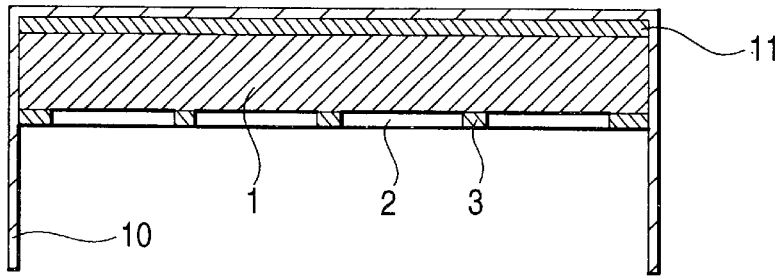
FIG. 5 is a sectional view of an embodiment of a fixing structure of a sound absorbing structure (first sound absorbing structure) according to the invention and a cover main body.
Figure 6:
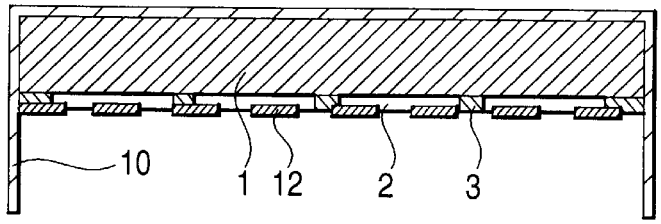
FIG. 6 is a diagram of another embodiment of a fixing structure of a sound absorbing structure (first sound absorbing structure) according to the invention and a cover main body.
Figure 7:
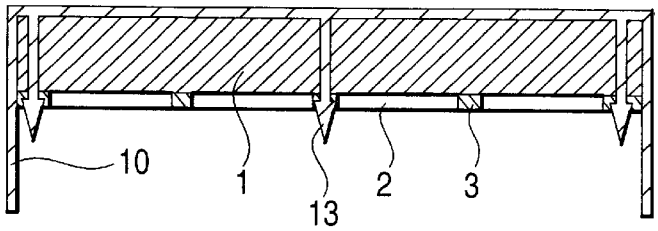
FIG. 7 is a diagram of still another embodiment of a fixing structure of a sound absorbing structure (first sound absorbing structure) according to the invention and a cover main body.

As to the method for fixing the sound absorbing structure onto the inner surface of the soundproof cover, various methods can be adopted. Hereafter, with reference to the first sound absorbing structure, a preferable embodiment of the fixing method will be described. For embodiment, as shown in FIG. 5, with the film 3 having the through holes 2 formed, of the sound absorbing structure directed to the sound source, the interface of the porous member 1 and the cover main body 10 can be fixed by a bonding means 11 such as an adhesive, a bond, and a bonding tape. Moreover, as shown in FIG. 6, the film 3 having the through holes 2 formed, of the sound absorbing structure may be covered with a mesh 12. Furthermore, as shown in FIG. 7, the sound absorbing structure may be fixed by a pin 13 projecting to the inner surface of the cover main body 10. FIGS. 5 to 7 are shown along the I—I section in FIG. 1.

EMBODIMENTS

Hereinafter, the invention will be described in further detail with reference to specific embodiments, but the invention is not limited to the following embodiments. The embodiments 1 to 6 and the comparative example 7 correspond to the first sound absorbing structure. The embodiment 7 corresponds to the second sound absorbing structure. The embodiment 8 corresponds to the third sound absorbing structure. The embodiment 9 and the comparative example 8 correspond to a configuration wherein a film without a hole is laminated further on the first sound absorbing structure (see FIG. 2).

Figure 8:
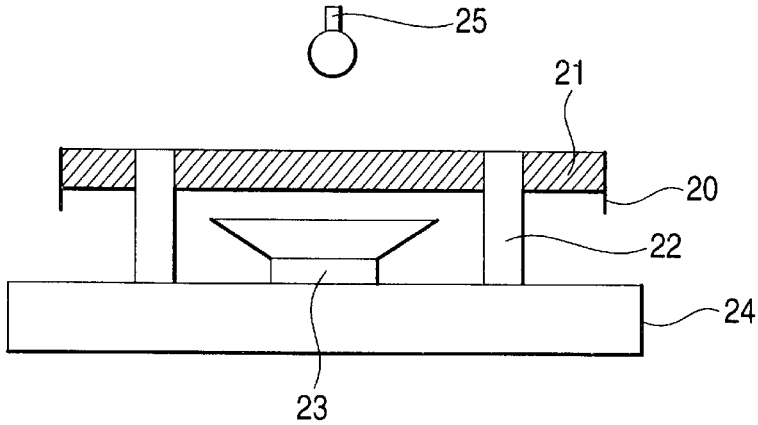
FIG. 8 is a schematic diagram showing the configuration of a device used for measuring the sound absorbing characteristic in the embodiments.

Moreover, in the embodiments 1 to 9 and the comparative examples 1 to 8, the normal incidence sound absorption coefficient was measured in the rigid wall close contact condition based on the JIS A1405. Furthermore, in the embodiments 10 to 18 and the comparative examples 9 to 16, the noise insulation effect was evaluated using the measurement device shown in FIG. 8. That is, with a stainless steel container having a rectangular bottom surface part of 435 mm×330 mm in size and 35 mm in depth used as a soundproof cover 20, and a sound absorbing structure 21 of 435 mm×330 mm in size was fixed on the inside thereof using a bond. Then, the soundproof cover 20 was installed on an aluminum plate 24 by fixing by a bonding tape such that the sound absorbing structure 21 faces a speaker via aluminum legs 22 having a rectangular sectional shape of 20 mm×50 mm in size and 50 mm in height. At the time of the measurement, a white noise was radiated from the speaker and the noise level was measured by a microphone 25 installed immediately above the soundproof cover 20 by 50 mm. The noise level was measured for the frequency range of 250 to 5,000 Hz by a ⅓ octave band resolution. The same noise measurement was executed for the soundproof cover 20 itself not provided with the sound absorbing structure 21. The noise insulation effect of the sound absorbing structure 21 was found by subtracting the noise level of the soundproof cover 20 provided with the sound absorbing structure 21 from the noise level of the single body of the soundproof cover 20. A large noise insulation effect value of the sound absorbing structure 21 represents the effectiveness in the noise reduction.

Embodiment 1

In a plain woven glass cloth defined corresponding to the EP18A in the JIS R3414 having a thickness of 0.18 mm, a density of 41×32 threads/25 mm, and a ventilation ratio of 0.93 $cm^3/cm^2/sec$, through holes of ϕ5 mm were formed on the intersections of a lattice having a pitch of 20 mm so as to provide a film. By adhering the same with a glass wool sheet having a bulk density of 48 $kg/m^3$ and a thickness of 10 mm by an adhesive, a sound absorbing structure was provided. Then, the sound absorbing structure was installed such that the surface without having the glass cloth adhered was disposed to the rigid wall side for measuring the normal incidence sound absorption coefficient of the sound absorbing structure.

Embodiment 2

In a plain woven glass cloth defined corresponding to the EP18A in the JIS R3414 having a thickness of 0.18 mm, a density of 41×32 threads/25 mm, and a ventilation ratio of 0.93 $cm^3/cm^2/sec$, through holes of ϕ10 mm were formed on the intersections of a lattice having a pitch of 20 mm so as to provide a film. By adhering the same with a glass wool sheet having a bulk density of 48 $kg/m^3$ and a thickness of 10 mm by an adhesive, a sound absorbing structure was provided. Then, the sound absorbing structure was installed such that the surface without having the glass cloth adhered was disposed to the rigid wall side for measuring the normal incidence sound absorption coefficient of the sound absorbing structure.

Embodiment 3

In a plain woven glass cloth defined corresponding to the EP18A in the JIS R3414 having a thickness of 0.18 mm, a density of 41×32 threads/25 mm, and a ventilation ratio of 0.93 $cm^3/cm^2/sec$, through holes of ϕ13 mm were formed on the intersections of a lattice having a pitch of 20 mm so as to provide a film. By adhering the same with a glass wool sheet having a bulk density of 48 $kg/m^3$ and a thickness of 10 mm by an adhesive, a sound absorbing structure was provided. Then, the sound absorbing structure was installed such that the surface without having the glass cloth adhered was disposed to the rigid wall side for measuring the normal incidence sound absorption coefficient of the sound absorbing structure.

Embodiment 4

In a plain woven glass cloth defined corresponding to the EP18A in the JIS R3414 having a 10 mm thickness of 10 mm, a density of 41×32 threads/25 mm, and a ventilation ratio of 0.93 $cm^3/cm^2/sec$, through holes of ϕ10 mm were formed on the intersections of a lattice having a pitch of 30 mm so as to provide a film. By adhering the same with a glass wool sheet having a bulk density of 48 $kg/m^3$ and a thickness of 10 mm by an adhesive, a sound absorbing structure was provided. Then, the sound absorbing structure was installed such that the surface without having the glass cloth adhered was disposed to the rigid wall side for measuring the normal incidence sound absorption coefficient of the sound absorbing structure.

Embodiment 5

In a plain woven glass cloth defined corresponding to the EP18A in the JIS R3414 having a thickness of 0.18 mm, a density of 41×32 threads/25 mm, and a ventilation ratio of 0.93 $cm^3/cm^2/sec$, through holes of ϕ 10 mm were formed on the intersections of a lattice having a pitch of 20 mm so as to provide a film. By adhering the same with a glass wool sheet having a bulk density of 48 $kg/m^3$ and a thickness of 20 mm by an adhesive, a sound absorbing structure was provided. Then, the sound absorbing structure was installed such that the surface without having the glass cloth adhered was disposed to the rigid wall side for measuring the normal incidence sound absorption coefficient of the sound absorbing structure.

Embodiment 6

In a polyethylene film having a thickness of 0.05 mm, and a ventilation ratio of 0.1 $cm^3/cm^2/sec$ or less, through holes of ϕ10 mm were formed on the intersections of a lattice having a pitch of 20 mm so as to provide a film. By adhering the same on one side of a soft urethane foam material sheet having a thickness of 10 mm, a bulk density of 25 $kg/m^3$ and a water absorption coefficient of 0.76 $g/cm^3$ by an adhesive, a sound absorbing structure was provided. Then, the sound absorbing structure was installed such that the surface without having the polyethylene film adhered was disposed to the rigid wall side for measuring the normal incidence sound absorption coefficient of the sound absorbing structure.

Embodiment 7

In a plain woven glass cloth defined corresponding to the EP18A in the JIS R3414 having a thickness of 0.18 mm, a density of 41×32 threads/25 mm, and a ventilation ratio of 0.93 $cm^3/cm^2/sec$, through holes of ϕ10 mm were formed on the intersections of a lattice having a pitch of 20 mm so as to provide a film. By adhering the same with a glass wool sheet having a bulk density of 48 $kg/m^3$ and a thickness of 10 mm by an adhesive, a sound absorbing structure (A) was provided. A plain woven glass cloth defined corresponding to the EP18A in the JIS R3414 having a thickness of 0.18 mm, a density of 41×32 threads/25 mm, and a ventilation ratio of 0.93 $cm^3/cm^2/sec$ was used as a film without a hole. By adhering the same with a glass wool sheet having a bulk density of 48 $kg/m^3$, and a thickness of 10 mm by an adhesive, a sound absorbing structure (B) was provided. Then, the surface of the structure (A) without having the glass cloth adhered and the glass cloth surface of the structure (B) were adhered by an adhesive so as to provide a sound absorbing structure. Then, the sound absorbing structure was installed such that the structure (B) was disposed to the rigid wall side for measuring the normal incidence sound absorption coefficient of the sound absorbing structure.

Embodiment 8

In a plain woven glass cloth defined corresponding to the EP18A in the JIS R3414 having a thickness of 0.18 mm, a density of 41×32 threads/25 mm, and a ventilation ratio of 0.93 $cm^3/cm^2/sec$, through holes of ϕ10 mm were formed on the intersections of a lattice having a pitch of 20 mm so as to provide a film. By adhering the same with a glass wool sheet having a bulk density of 48 $kg/^3$ and a thickness of 10 mm by an adhesive, a sound absorbing structure (A) was provided. In a plain woven glass cloth defined corresponding to the EP18A in the JIS R3414 having a thickness of 0.18 mm, a density of 41×32 threads/25 mm, and a ventilation ratio of 0.93 $cm^3/cm^2/sec$, through holes of ϕ5 mm were formed on the intersections of a lattice having a pitch of 20 mm so as to provide a film. By adhering the same with a glass wool sheet having a bulk density of 48 $kg/m^3$ and a thickness of 10 mm by an adhesive, a sound absorbing structure (B) was provided. Then, the surface of the structure (A) without having the glass cloth adhered and the glass cloth surface of the structure (B) were adhered by an adhesive such that the through holes provided in the glass clothes are disposed concentrically so as to provide a sound absorbing structure. Then, the sound absorbing structure was installed such that the structure (B) was disposed to the rigid wall side for measuring the normal incidence sound absorption coefficient of the sound absorbing structure.

Embodiment 9

In a plain woven glass cloth defined corresponding to the EP18A in the JIS R3414 having a thickness of 0.18 mm, a density of 41×32 threads/25 mm, and a ventilation ratio of 0.93 $cm^3/cm^2/sec$, through holes of ϕ10 mm were formed on the intersections of a lattice having a pitch of 20 mm so as to provide a film. Moreover, a plain woven glass cloth defined corresponding to the EP16A in the JIS R3414 having a thickness of 0.14 mm, a density of 32×25 threads/25 mm, and a ventilation ratio of 633 $cm^3/cm^2/sec$ was used as a film without a hole. On one side of a glass wool sheet having a bulk density of 48 $kg/m^3$ and a thickness of 10 mm, the film, and the film without a hole were laminated and adhered by an adhesive so as to provide a sound absorbing structure. Then, the sound absorbing structure was installed such that the surface without having the glass cloth adhered was disposed to the rigid wall side for measuring the normal incidence sound absorption coefficient of the sound absorbing structure.

Embodiment 10

With the sound absorbing structure of the embodiment 1, the surface without having a glass cloth adhered was adhered on a soundproof cover by an adhesive for measuring the noise insulation effect of the sound absorbing structure.

Embodiment 11

With the sound absorbing structure of the embodiment 2, the surface without having a glass cloth adhered was adhered on a soundproof cover by an adhesive for measuring the noise insulation effect of the sound absorbing structure.

Embodiment 12

With the sound absorbing structure of the embodiment 3, the surface without having a glass cloth adhered was adhered on a soundproof cover by an adhesive for measuring the noise insulation effect of the sound absorbing structure.

Embodiment 13

With the sound absorbing structure of the embodiment 4, the surface without having a glass cloth adhered was adhered on a soundproof cover by an adhesive for measuring the noise insulation effect of the sound absorbing structure.

Embodiment 14

With the sound absorbing structure of the embodiment 5, the surface without having a glass cloth adhered was adhered on a soundproof cover by an adhesive for measuring the noise insulation effect of the sound absorbing structure.

Embodiment 15

With the sound absorbing structure of the embodiment 6, the surface without having a polyethylene film adhered was adhered on a soundproof cover by an adhesive for measuring the noise insulation effect of the sound absorbing structure.

Embodiment 16

With the sound absorbing structure of the embodiment 7, the surface without having a glass cloth adhered was adhered on a soundproof cover by an adhesive for measuring the noise insulation effect of the sound absorbing structure.

Embodiment 17

With the sound absorbing structure of the embodiment 8, the surface without having a glass cloth adhered was adhered on a soundproof cover by an adhesive for measuring the noise insulation effect of the sound absorbing structure.

Embodiment 18

With the sound absorbing structure of the embodiment 9, the surface without having a glass cloth adhered was adhered on a soundproof cover by an adhesive for measuring the noise insulation effect of the sound absorbing structure.

COMPARATIVE EXAMPLE 1

The normal incidence sound absorption coefficient of a sound absorbing structure comprising a soft urethane foam material sheet having a thickness of 10 mm, a bulk density of 25 kg/m$^3$, and a water absorption coefficient of 0.76 g/cm$^3$ was measured.

COMPARATIVE EXAMPLE 2

The normal incidence sound absorption coefficient of a sound absorbing structure comprising a soft urethane foam material sheet having a thickness of 20 mm, a bulk density of 25 kg/m$^3$, and a water absorption coefficient of 0.76 g/cm$^3$ was measured.

COMPARATIVE EXAMPLE 3

The normal incidence sound absorption coefficient of a sound absorbing structure comprising a foam material sheet made of EPDM having a thickness of 10 mm, a bulk density of 100 kg/m$^3$, and a water absorption coefficient of 0.071 g/cm$^3$ was measured.

COMPARATIVE EXAMPLE 4

The normal incidence sound absorption coefficient of a sound absorbing structure comprising a foam material sheet made of EPDM having a thickness of 10 mm, a bulk density of 460 kg/m$^3$, and a water absorption coefficient of 0.0028 g/cm$^3$ was measured.

COMPARATIVE EXAMPLE 5

The normal incidence sound absorption coefficient of a sound absorbing structure comprising a glass wool sheet having a bulk density of 48 kg/m$^3$, and a thickness of 10 mm was measured.

COMPARATIVE EXAMPLE 6

A plain woven glass cloth defined corresponding to the EP18A in the JIS R3414 having a thickness of 0.18 mm, a density of 41×32 threads/25 mm, and a ventilation ratio of 0.93 cm$^3$/cm$^2$/sec was used as a film. By adhering the same with a glass wool sheet having a bulk density of 48 kg/m$^3$, and a thickness of 10 mm by an adhesive, a sound absorbing structure was provided. Then, the sound absorbing structure was installed such that the surface without having the glass cloth adhered was disposed to the rigid wall side for measuring the normal incidence sound absorption coefficient of the sound absorbing structure.

Comparative Embodiment 7

In a plain woven glass cloth defined corresponding to the EP16A in the JIS R3414 having a thickness of 0.14 mm, a density of 32×25 threads/25 mm, and a ventilation ratio of 633 cm$^3$/cm$^2$/sec, through holes of ϕ10 mm were formed on the intersections of a lattice having a pitch of 20 mm so as to provide a film. The same was adhered on one side of a glass wool sheet having a bulk density of 48 kg/m$^3$ and a thickness of 10 mm by an adhesive so as to provide a sound absorbing structure. Then, the sound absorbing structure was installed such that the surface without having the glass cloth adhered was disposed to the rigid wall side for measuring the normal incidence sound absorption coefficient of the sound absorbing structure.

Comparative Embodiment 8

In a plain woven glass cloth defined corresponding to the EP18A in the JIS R3414 having a thickness of 0.18 mm, a density of 41×32 threads/25 mm, and a ventilation ratio of 0.93 cm$^3$/cm$^2$/sec, through holes of ϕ10 mm were formed on the intersections of a lattice having a pitch of 20 mm so as to provide a film. Moreover, a plain woven glass cloth defined corresponding to the EP18A in the JIS R3414 having a thickness of 0.18 mm, a density of 41×32 threads/25 mm, and a ventilation ratio of 0.93 cm$^3$/cm$^2$/sec was used as a film without a hole. On one side of a glass wool sheet having a bulk density of 48 kg/m$^3$ and a thickness of 10 mm, the film without a hole, and the film were laminated and adhered by an adhesive so as to provide a sound absorbing structure. Then, the sound absorbing structure was installed such that the surface without having the glass cloth adhered was disposed to the rigid wall side for measuring the normal incidence sound absorption coefficient of the sound absorbing structure.

COMPARATIVE EXAMPLE 9

With the sound absorbing structure of the comparative example 1, the sound absorbing structure and a soundproof cover were adhered by an adhesive for measuring the noise insulation effect of the sound absorbing structure.

COMPARATIVE EXAMPLE 10

With the sound absorbing structure of the comparative example 2, the sound absorbing structure and a soundproof cover were adhered by an adhesive for measuring the noise insulation effect of the sound absorbing structure.

COMPARATIVE EXAMPLE 11

With the sound absorbing structure of the comparative example 3, the sound absorbing structure and a soundproof cover were adhered by an adhesive for measuring the noise insulation effect of the sound absorbing structure.

COMPARATIVE EXAMPLE 12

With the sound absorbing structure of the comparative example 4, the sound absorbing structure and a soundproof cover were adhered by an adhesive for measuring the noise insulation effect of the sound absorbing structure.

COMPARATIVE EXAMPLE 13

With the sound absorbing structure of the comparative example 5 used, the sound absorbing structure and a soundproof cover were adhered by an adhesive for measuring the noise insulation effect of the sound absorbing structure.

COMPARATIVE EXAMPLE 14

With the sound absorbing structure of the comparative example 6, the sound absorbing structure and a soundproof cover were adhered by an adhesive for measuring the noise insulation effect of the sound absorbing structure.

COMPARATIVE EXAMPLE 15

With the sound absorbing structure of the comparative example 7, the sound absorbing structure and a soundproof cover were adhered by an adhesive for measuring the noise insulation effect of the sound absorbing structure.

COMPARATIVE EXAMPLE 16

With the sound absorbing structure of the comparative example 8, the sound absorbing structure and a soundproof cover were adhered by an adhesive for measuring the noise insulation effect of the sound absorbing structure.

The materials of the porous member and the film, and the configuration of each of the sound absorbing materials are shown in the tables 1 and 2.

TABLE 1

| | | | Embodiment No. | | | | | | | | |
|---|---|---|---|---|---|---|---|---|---|---|---|
| | | | 1<br>10 | 2<br>11 | 3<br>12 | 4<br>13 | 5<br>14 | 6<br>15 | 7<br>16 | 8<br>17 | 9<br>18 |
| Sound Source Side | Film | Material | Glass cloth | Glass cloth | Glass cloth | Glass cloth | Glass cloth | Polyethylene Film | Glass cloth | Glass cloth | Glass cloth |
| | | Ventilation ratio ($cm^3/cm^2/sec$) | 0.93 | 0.93 | 0.93 | 0.93 | 0.93 | 0.1 or less | 0.93 | 0.93 | 0.93 |
| | | Hole diameter (mm) | 5 | 10 | 13 | 10 | 10 | 10 | 10 | 10 | 10 |
| | | Lattice pitch (mm) | 20 | 20 | 20 | 30 | 20 | 20 | 20 | 20 | 20 |
| | Film without a hole | Material | — | — | — | — | — | — | — | — | Glass cloth |
| | | Ventilation ratio ($cm^3/cm^2/sec$) | — | — | — | — | — | — | — | — | 633 |
| | Porous member | Material | Glass wool | Glass wool | Glass wool | Glass wool | Glass wool | Urethane | Glass wool | Glass wool | Glass wool |
| | | Water absorption coefficient ($g/cm^3$) | — | — | — | — | — | 0.76 | — | — | — |
| | | Thickness (mm) | 10 | 10 | 10 | 10 | 20 | 10 | 10 | 10 | 10 |
| Rigid Wall Side or Cover Main Body Side | Film | Material | — | — | — | — | — | — | Glass cloth | Glass cloth | — |
| | | Ventilation ratio ($cm^3/cm^2/sec$) | — | — | — | — | — | — | 0.93 | 0.93 | — |
| | | Hole diameter (mm) | — | — | — | — | — | — | Without hole | 5 | — |
| | | Lattice pitch (mm) | — | — | — | — | — | — | Without hole | 20 | — |
| | Porous member | Material | — | — | — | — | — | — | Glass wool | Glass wool | — |
| | | Water absorption coefficient ($g/cm^3$) | — | — | — | — | — | — | — | — | — |
| | | Thickness (mm) | — | — | — | — | — | — | 10 | 10 | — |

*In the case where the porous member is provided as a single layer, the structure is shown in the column of the sound source side material.

TABLE 2

| | | Comparative example No. | | | | | | | |
|---|---|---|---|---|---|---|---|---|---|
| | | 1<br>9 | 2<br>10 | 3<br>11 | 4<br>12 | 5<br>13 | 6<br>14 | 7<br>15 | 8<br>16 |
| Film | Material | — | — | — | — | — | Glass cloth | Glass cloth | Glass cloth |
| | Ventilation ratio ($cm^3/cm^2/sec$) | — | — | — | — | — | 0.93 | 633 | 0.93 |
| | Hole diameter (mm) | — | — | — | — | — | Without hole | 10 | 10 |
| | Lattice pitch (mm) | — | — | — | — | — | Without hole | 20 | 20 |
| Film without a hole | Material | — | — | — | — | — | — | — | Glass cloth |
| | Ventilation ratio ($cm^3/cm^2/sec$) | — | — | — | — | — | — | — | 0.93 |
| Porous member | Material | Urethane | Urethane | EPDM | EPDM | Glass wool | Glass wool | Glass wool | Glass wool |
| | Water absorption coefficient ($g/cm^3$) | 0.76 | 0.76 | 0.071 | 0.0028 | — | — | — | — |
| | Thickness (mm) | 10 | 20 | 10 | 10 | 10 | 10 | 10 | 10 |

Figure 9:
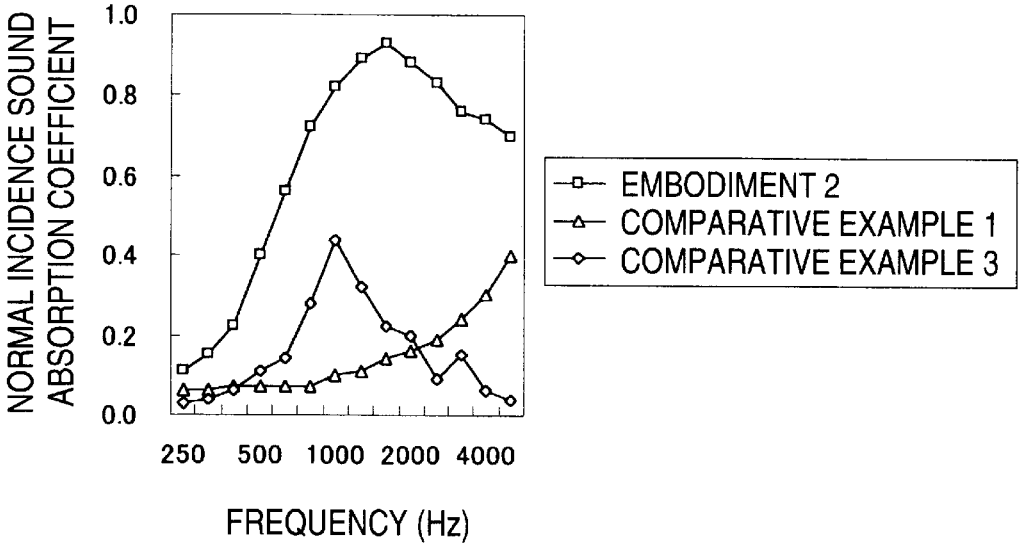
FIG. 9 is a graph of the measurement of the sound absorption coefficient in the embodiment 2, and the comparative examples 1 and 3.
Figure 10:
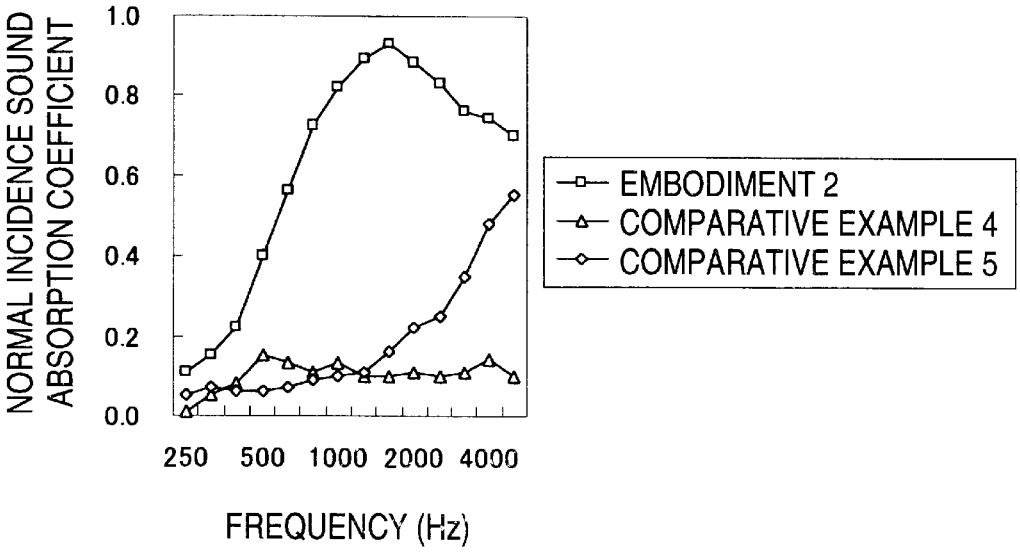
FIG. 10 is a graph of the measurement of the sound absorption coefficient in the embodiment 2, and the comparative examples 4 and 5.
Figure 11:
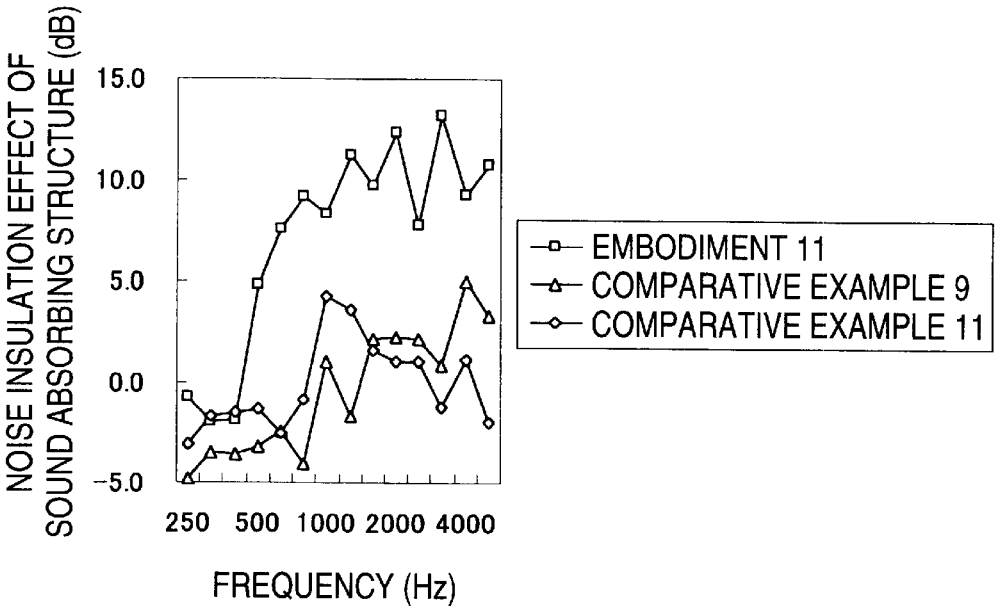
FIG. 11 is a graph of the measurement of the noise insulation effect in the embodiment 11, and the comparative examples 9 and 11.
Figure 12:
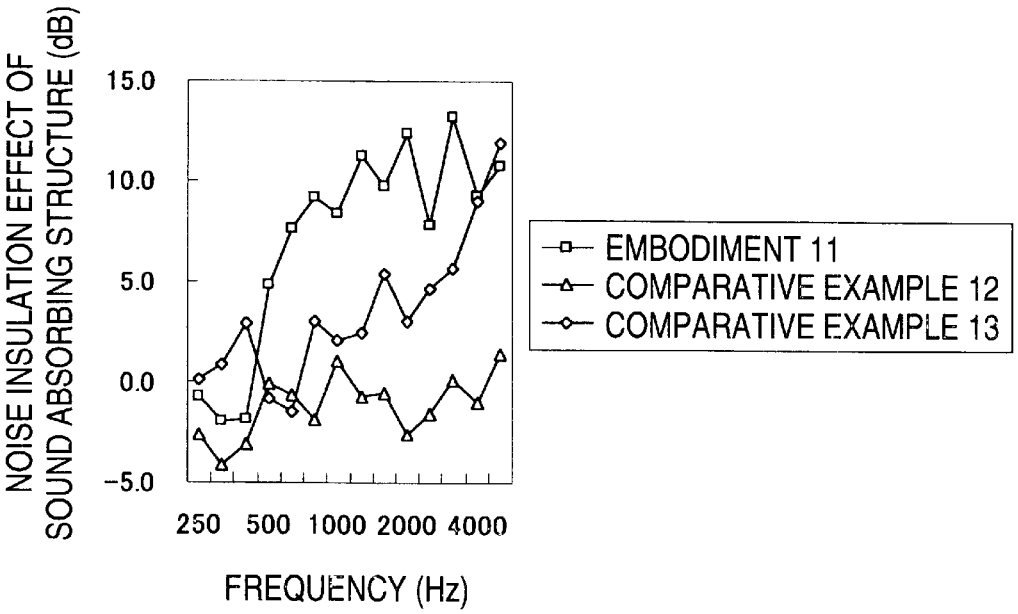
FIG. 12 is a graph of the measurement of the noise insulation effect in the embodiment 11, and the comparative examples 12 and 13.
Figure 13:
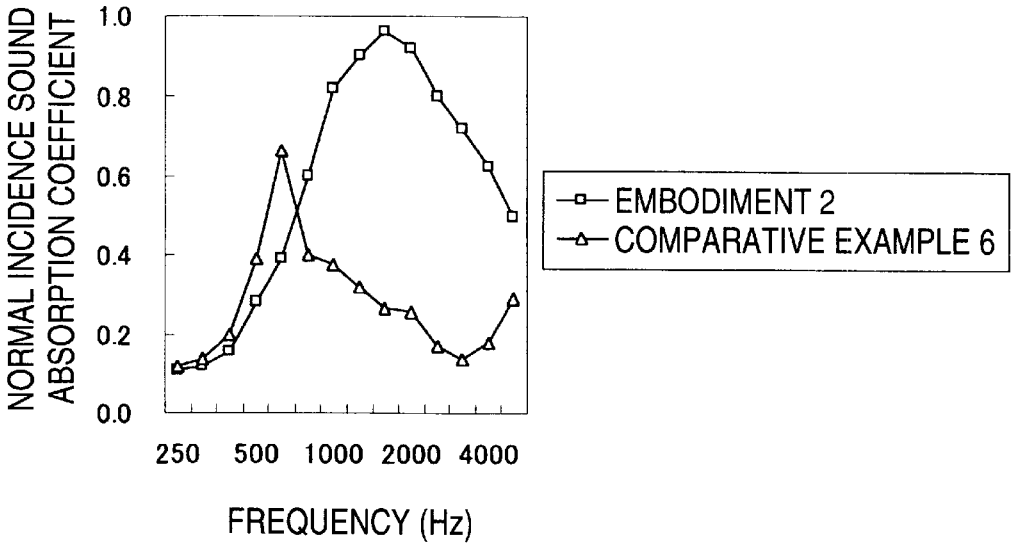
FIG. 13 is a graph of the measurement of the sound absorption coefficient in the embodiment 2, and the comparative example 6.

In the above-mentioned description, the embodiment 2 provides the sound absorbing structure according to the invention, and the comparative examples 1, 3 to 5 are the cases using commonly used sound absorbing materials, that is, an open cell urethane foam, a half closed cell foam, a closed cell foam, and a glass wool. In the embodiment 2, and the comparative examples 1, 3 to 5, the thickness is the same. The embodiment 11 is for measuring the noise insulation effect of the sound absorbing structure provided in the embodiment 2. The comparative examples 9, 11 to 13 are for measuring the noise insulation effect of the commonly used sound absorbing materials of the comparative examples 1, 3 to 5. Measurement results of the normal incidence sound absorption coefficient of the embodiment 2, and the comparative examples 1 and 3 are shown in FIG. 9. Measurement results of the normal incidence sound absorption coefficient of the embodiment 2, and the comparative examples 4 and 5 are shown in FIG. 10. Measurement results of the noise insulation effect of the embodiment 11, and the comparative examples 9 and 11 are shown in FIG. 12. Measurement results of the noise insulation effect of the embodiment 11, and the comparative examples 12 and 13 are shown in FIG. 13. According to the figures, the embodiments 2 and 11 according to the invention show higher sound absorption coefficient and noise insulation effect in the substantially all frequency range compared with the commonly used sound absorbing materials of the comparative examples.

Figure 14:
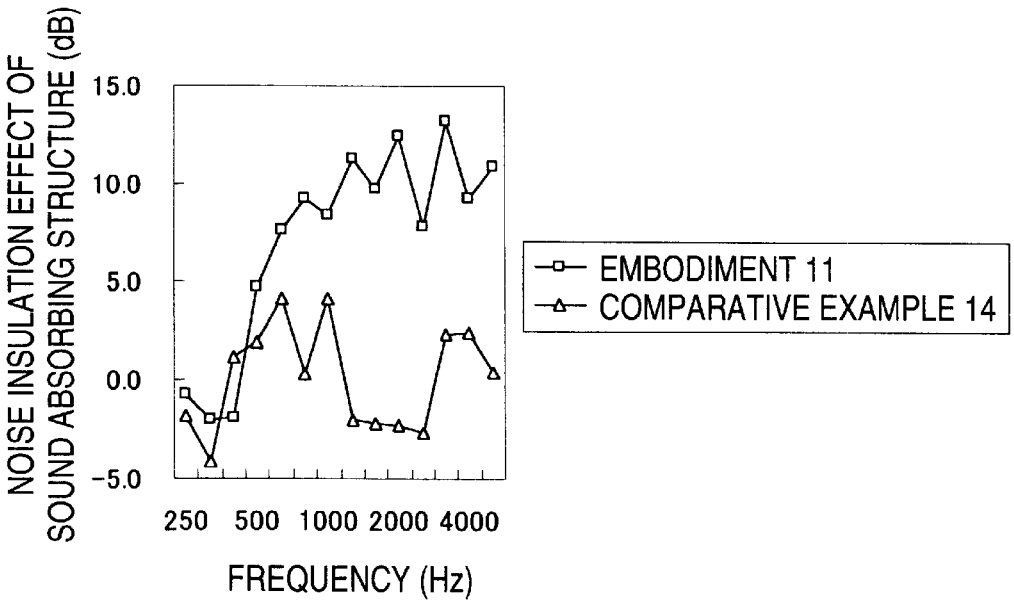
FIG. 14 is a graph of the measurement of the noise insulation effect in the embodiment 11, and the comparative example 14.

In the embodiment 2 and the comparative example 6, a glass wool is integrated with a glass cloth having a low ventilation ratio. In the embodiment 2 according to the invention, through holes are provided in the glass cloth, whereas through holes are not provided in the comparative example 6. The embodiment 11 is for measuring the noise insulation effect of the sound absorbing structure provided in the embodiment 2. The comparative example 14 is for measuring the noise insulation effect of the structure not provided with the through holes of the comparative example 6. Measurement results of the normal incidence sound absorption coefficient of the embodiment 2, and the comparative example 6 are shown in FIG. 13. Measurement results of the noise insulation effect of the embodiment 11, and the comparative example 14 are shown in FIG. 14. According to the figures, the comparative examples 6 and 14 not provided with the through holes show slightly high sound absorption coefficient and noise insulation effect only in a single narrow frequency range, whereas the embodiments 2 and 11 show high sound absorption coefficient and noise insulation effect over a wide frequency range.

Figure 15:
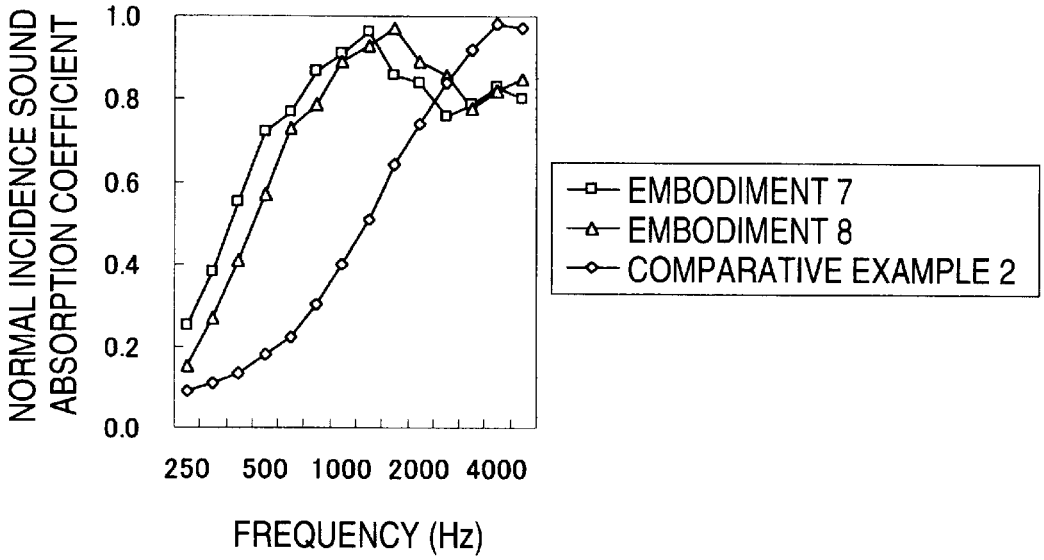
FIG. 15 is a graph of the measurement of the sound absorption coefficient in the embodiments 7, 8, and the comparative example 2.
Figure 16:
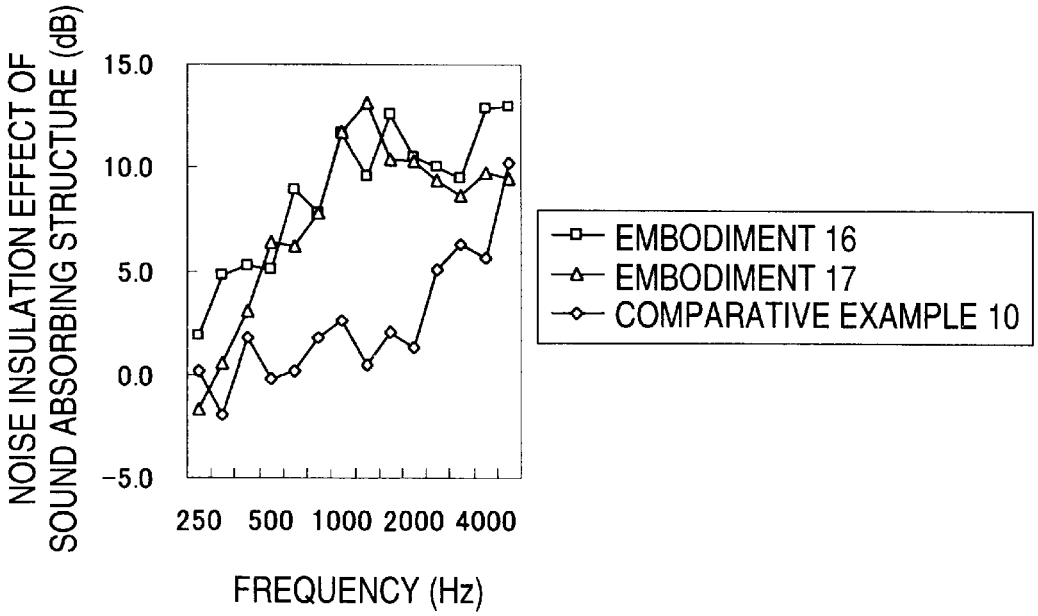
FIG. 16 is a graph of the measurement of the noise insulation effect in the embodiments 16, 17 and the comparative example 10.

The embodiments 7, 8 provide a sound absorbing structure of the invention comprising structures produced by integrating a porous member and a glass cloth laminated, wherein through holes are provided in the glass cloth in the layer closer to the sound source in both embodiments. Through holes are not provided in the glass cloth farther from the sound source in the embodiment 7, but through holes are provided in the glass cloth farther from the sound source in the embodiment 8. The comparative example 2 utilizes a commonly used sound absorbing material, a urethane foam. In the embodiments 7, 8, and the comparative example 2, the thickness of the sound absorbing structures is same. The embodiments 16 and 17 are for measuring the noise insulation effect of the sound absorbing structures provided in the embodiments 7 and 8. The comparative example 10 is for measuring the noise insulation effect of the structure of the comparative example 2. Measurement results of the normal incidence sound absorption coefficient of the embodiments 7, 8, and the comparative example 2 are shown in FIG. 15. Measurement results of the noise insulation effect of the embodiments 16, 17, and the comparative example 10 are shown in FIG. 16. According to the figures, the embodiments 7, 8, 16 and 17 with the structure produced by integrating a porous member and a film show high sound absorption coefficient and noise insulation effect over an extremely wide frequency range, whereas the comparative examples 2 and 10 with the commonly used sound absorbing materials show high sound absorption coefficient and noise insulation effect only in a high frequency range.

Figure 17:
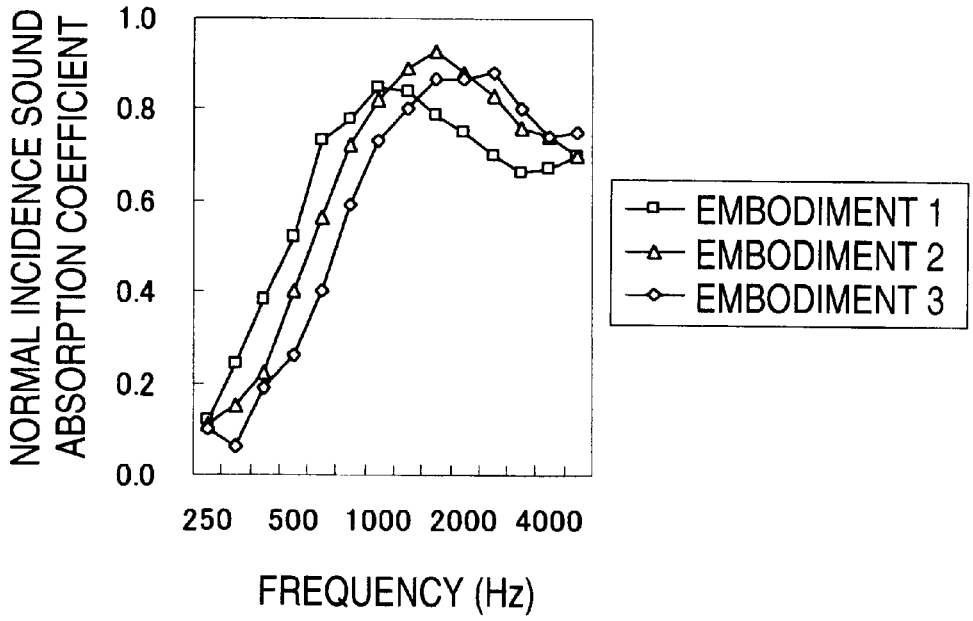
FIG. 17 is a graph of the measurement of the sound absorption coefficient in the embodiments 1, 2, and the comparative example 3.
Figure 18:
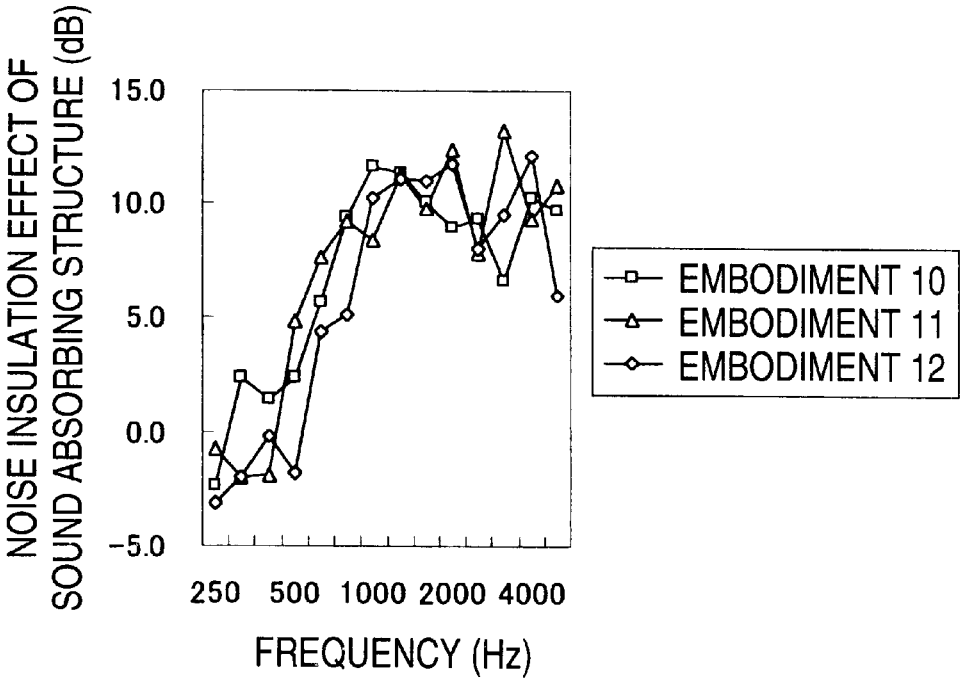
FIG. 18 is a graph of the measurement of the noise insulation effect in the embodiments 10, 11, and the comparative example 12.

The embodiments 1 to 3 provide a sound absorbing structure of the invention using a glass cloth and a glass wool, but the through hole diameters thereof differ. The embodiments 10 to 12 are for measuring the noise insulation effect of the sound absorbing structures provided in the embodiments 1 to 3. Measurement results of the normal incidence sound absorption coefficient of the embodiments 1 to 3 are shown in FIG. 17. Measurement results of the noise insulation effect of the embodiments 10 to 12 are shown in FIG. 18. According to the figures, the embodiments 1 to 3 according to the invention show a relatively high sound absorption coefficient over a relatively wide frequency range. Moreover, with a larger through hole diameter, the frequency range wherein the sound absorbing characteristic and the noise insulation effect appear moves to the higher frequency range. That is, according to the invention, by optionally changing the through hole diameter, the sound absorbing characteristic and the noise insulation effect of an optional frequency range can easily be improved.

Figure 19:
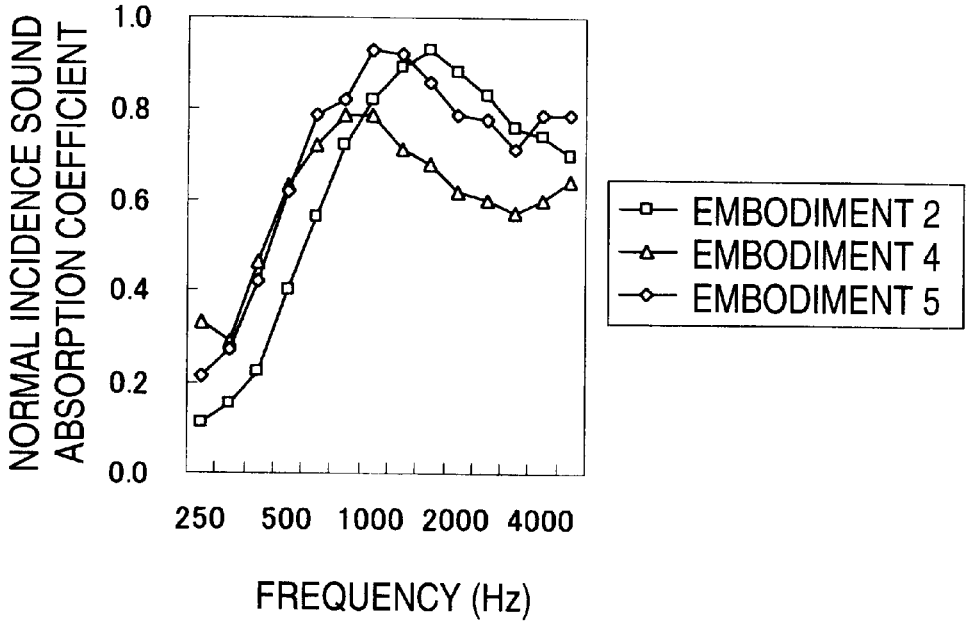
FIG. 19 is a graph of the measurement of the sound absorption coefficient in the embodiments 2, 4, and the comparative example 5.
Figure 20:
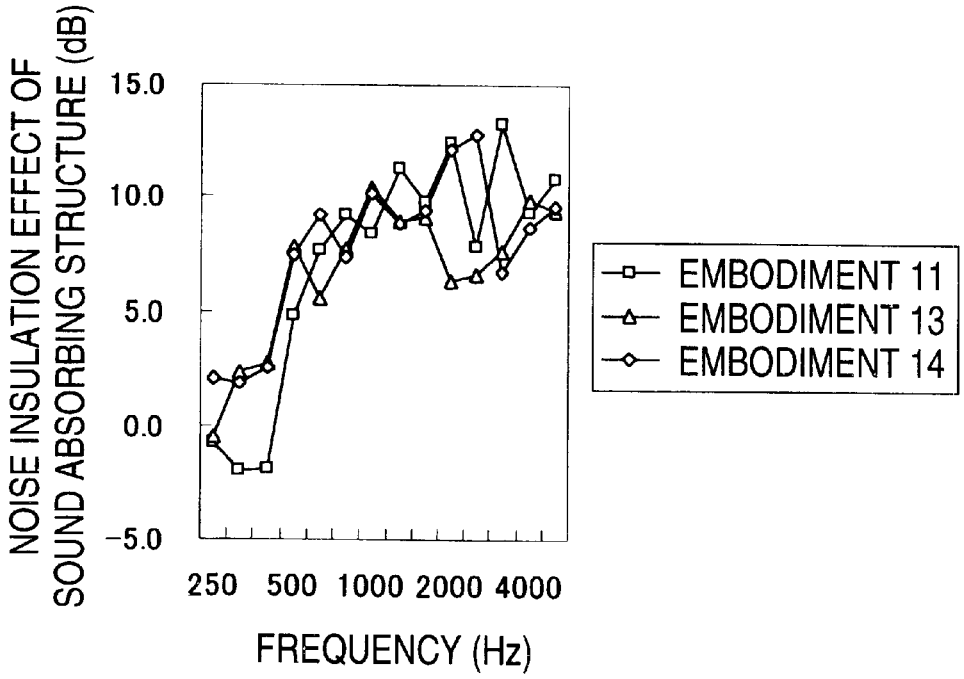
FIG. 20 is a graph of the measurement of the noise insulation effect in the embodiments 11, 13, and 14.

The embodiments 2, 4, 5 provide a sound absorbing structure of the invention using a glass cloth and a glass wool, provided with holes of the same diameter in the glass cloth, but the through hole intervals and the glass wool thicknesses thereof differ. The embodiments 11, 13, 14 are for measuring the noise insulation effect of the sound absorbing structures provided in the embodiments 2, 4, 5. Measurement results of the normal incidence sound absorption coefficient of the embodiments 2, 4, 5 are shown in FIG. 19. Measurement results of the noise insulation effect of the embodiments 11, 13, 14 are shown in FIG. 20. According to the figures, the embodiments 2, 4, 5 according to the invention show a high sound absorption coefficient over a relatively wide frequency range. Moreover, with a narrower through hole interval, the frequency range wherein the sound absorbing characteristic and the noise insulation effect appear moves to the higher frequency range. Furthermore, with a thicker structure thickness, the frequency range wherein the sound absorbing characteristic and the noise insulation effect appear moves to the lower frequency range. That is, according to the invention, by optionally changing the through hole arrangement and the thickness of the porous member, the sound absorbing characteristic and the noise insulation effect of an optional frequency range can easily be improved.

Figure 21:
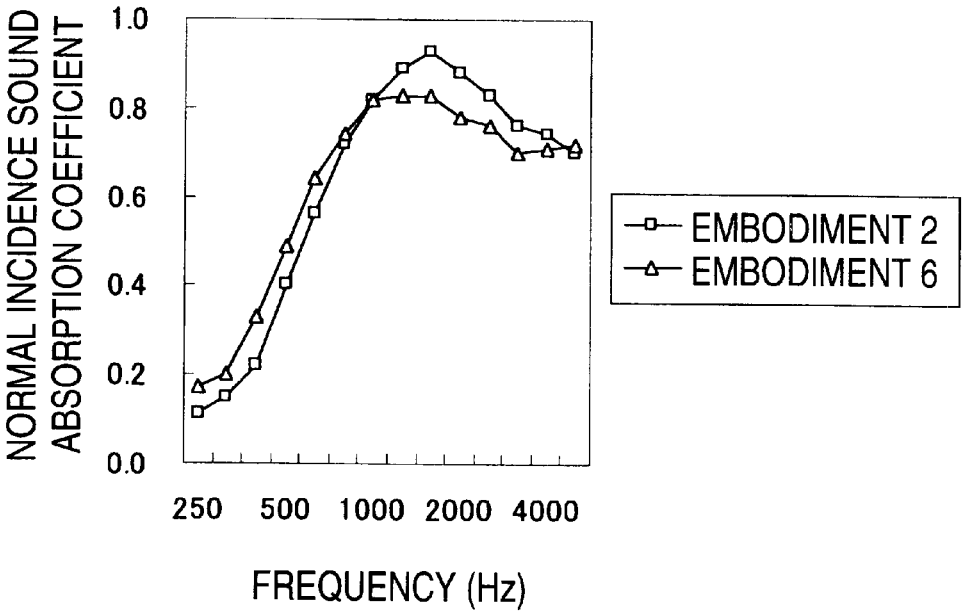
FIG. 21 is a graph of the measurement of the sound absorption coefficient in the embodiments 2 and 6.
Figure 22:
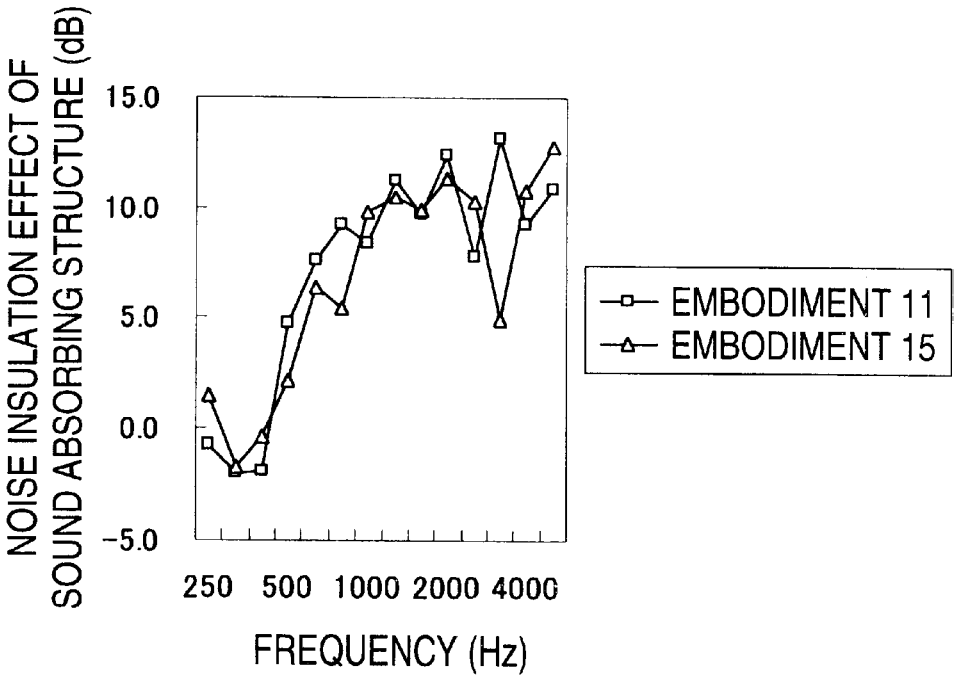
FIG. 22 is a graph of the measurement of the noise insulation effect in the embodiments 11 and 15.

The embodiments 2 and 6 provide a sound absorbing structure according to the invention using a porous member having communicating voids and a film-like material with a low ventilation ratio. A glass wool is used as the porous member and a glass cloth is used as the film-like material in the embodiment 2, and a urethane foam is used as the porous member and a polyethylene film is used as the film-like material in the embodiment 6. The embodiments 11 and 15 are for measuring the noise insulation effect of the sound absorbing structures provided in the embodiments 2 and 6. Measurement results of the normal incidence sound absorption coefficient of the embodiments 2 and 6 are shown in FIG. 21. Measurement results of the noise insulation effect of the embodiments 11 and 15 are shown in FIG. 22. According to the figures, the embodiments 2 and 6 according to the invention show high sound absorption coefficient and noise insulation effect over a relatively wide frequency range. That is, in the invention, an open cell structure foam material such as a urethane foam and a fibrous compact such as a glass wool can be used as the porous member.

Figure 23:
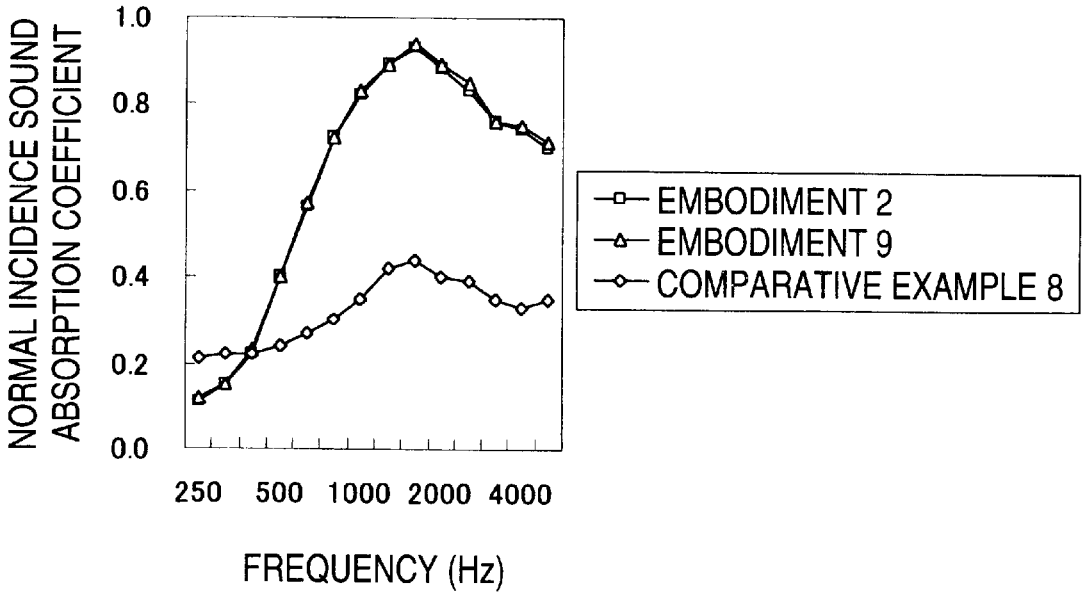
FIG. 23 is a graph of the measurement of the sound absorption coefficient in the embodiments 2, 9 and the comparative example 8.
Figure 24:
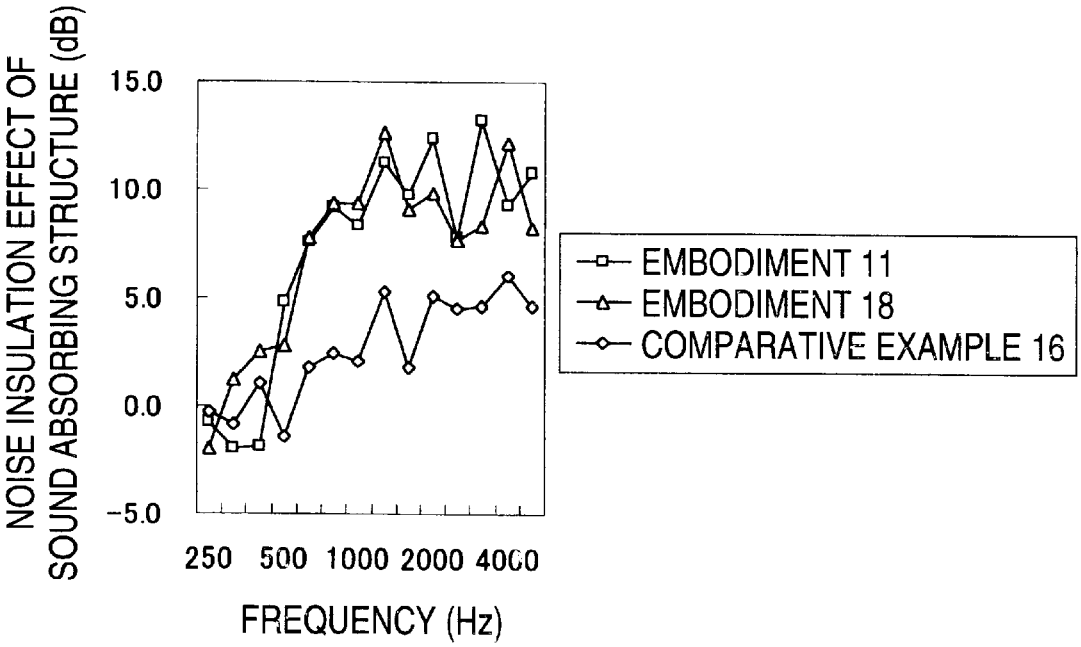
FIG. 24 is a graph of the measurement of the sound absorption coefficient in the embodiments 11, 18 and the comparative example 16.

In the embodiments 2, 9 and the comparative example 8, a glass cloth and a glass wool with a low ventilation ratio are used as the film material. The embodiments 2 and 9 provide a sound absorbing structure according to the invention. A glass cloth with a high ventilation ratio is used as the film without a hole in the embodiment 9, and a film without a hole is not used in the embodiment 2. A glass cloth with a low ventilation ratio is used as the material of the film without a hole in the comparative example 8. The embodiments 11, 18 are for measuring the noise insulation effect of the sound absorbing structures provided in the embodiments 2, 9. The comparative example 16 is for measuring the noise insulation effect of the sound absorbing structure of the comparative example 8. Measurement results of the normal incidence sound absorption coefficient of the embodiments 2, 9, and the comparative example 8 are shown in FIG. 23. Measurement results of the noise insulation effect of the embodiments 11, 18, and the comparative example 16 are shown in FIG. 24. According to the figures, the embodiments 2, 9, 11, 18 according to the invention show high sound absorption coefficient and noise insulation effect over a relatively wide frequency range. Although, a glass cloth with a high ventilation ratio is used as the material of the film without a hole in the embodiment 9, the normal incidence sound absorption coefficient and the noise insulation effect are substantially equal in the embodiments 2, 9, 11 and 18. In contrast, in the comparative examples 8 and 16 using a glass cloth with a low ventilation ratio as the film without a hole, the normal incidence sound absorption coefficient and the noise insulation effect show a lower value compared with those of the sound absorbing structures according to the invention. That is, in the invention, a film-like material with a high ventilation ratio can be used as the material of a film without a hole.

Figure 25:
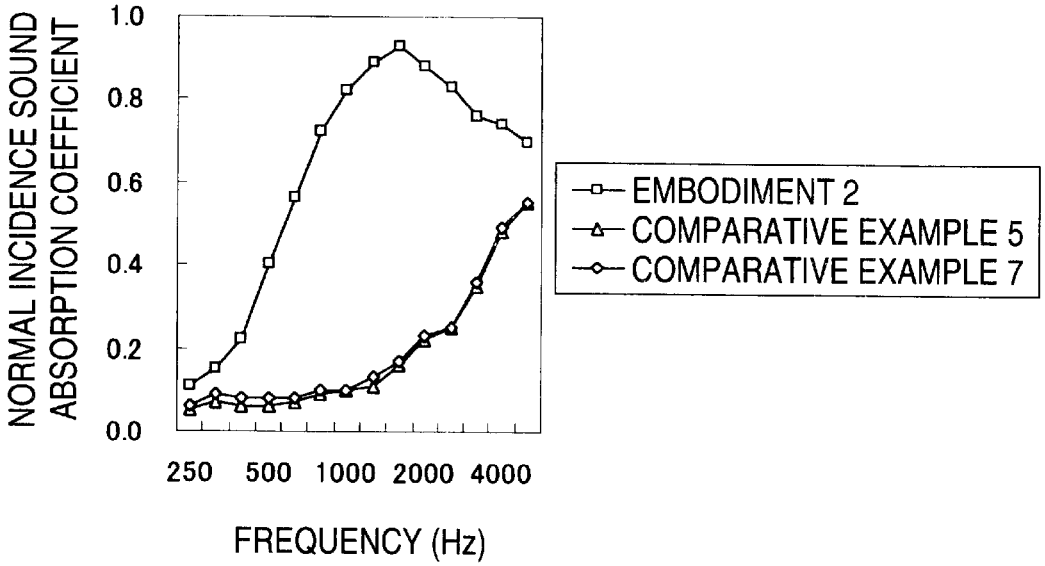
FIG. 25 is a graph of the measurement of the sound absorption coefficient in the embodiment 2, and the comparative examples 5 and 7.
Figure 26:
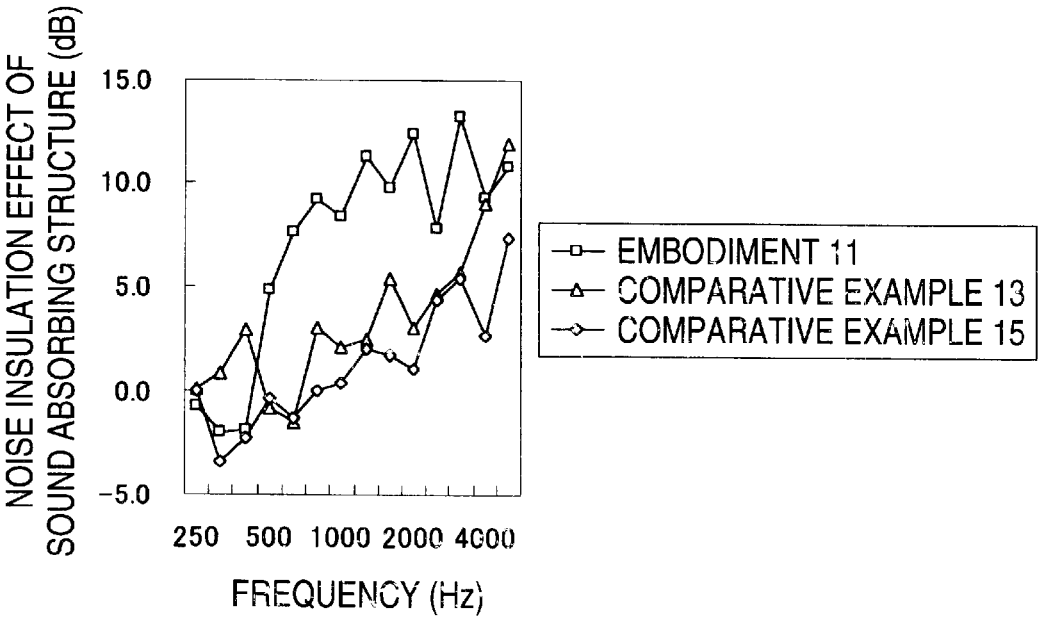
FIG. 26 is a graph of the measurement of the sound absorption coefficient in the embodiment 11 and the comparative examples 13 and 15.

In the embodiment 2, and the comparative examples 5 and 7, a glass wool of the same thickness is used as the base. In the embodiment 2 and the comparative example 7, a glass cloth provided with through holes and a glass wool are integrated. In the comparative example 5, a single body glass wool as a commonly used sound absorbing material is used. The embodiment 2 provides a sound absorbing structure according to the invention, wherein a glass cloth with a low ventilation ratio is used, whereas a glass cloth with a high ventilation ratio is used in the comparative example 7. The embodiment 11 is for measuring the noise insulation effect of the sound absorbing structure provided in the embodiment 2. The comparative examples 13 and 15 are for measuring the noise insulation effect of the sound absorbing structures of the comparative examples 5 and 7. Measurement results of the normal incidence sound absorption coefficient of the embodiment 2 and the comparative examples 5 and 7 are shown in FIG. 25. Measurement results of the noise insulation effect of the embodiment 11, and the comparative examples 13 and 15 are shown in FIG. 26. According to the figures, the embodiments 2 and 11 according to the invention show high sound absorption coefficient and noise insulation effect over a relatively wide frequency range, whereas the comparative examples 5, 7, 13 and 15 have the substantially equal normal incidence sound absorption coefficient and noise insulation effect on the whole at a low value. That is, in the invention, by using a film-like material with a low ventilation ratio as the film, a sound absorbing structure and a soundproof cover having good sound absorbing characteristic and noise insulation effect can be obtained.

From the results as heretofore described, it is apparent that the sound absorbing structures according to the invention show the excellent sound absorbing characteristic. Moreover, by optionally changing the arrangement (density) of the through holes provided in the sound absorbing structure, the sound absorption coefficient of a desired frequency can be improved regardless of the portion (thickness). Furthermore, in the case where it is installed in a soundproof cover, the noise level of an optional frequency range can be reduced so that the noise insulation effect can be realized according to the purpose.

What is claimed is:

1. A sound absorbing structure comprising a first structure including:

a first porous member having communicating voids;

a first film having through holes, said first film laminated on a film formation surface of said first porous member for facing a sound source; and a second film having no hole and a ventilation ratio of 100 $cm^3/cm^2/sec$ or more, and laminated on said first film so as to cover an entire surface of said first film, wherein at least one of said through holes of said first film has an opening area of 19 $mm^2$ or more, and the total of said opening area accounts for 1 to 70% with respect to an area of said film formation surface of said first porous member.

2. The sound absorbing structure according to claim 1, further comprising:

a second structure including:

a second porous member having communicating voids; and a third film having no hole and laminated on at least one surface of said second porous member, wherein said first structure is laminated on said second structure so that said first and third films faces the sound source.

3. The sound absorbing structure according to claim 1, wherein a plurality of said first structures are laminated so that said first film faces the sound source, and wherein said first structures are laminated such that the total of said opening area of said through holes of each first structure is successively reduced with that of said first structure disposed closest to the sound source maximum and that of said first structure disposed farthest to the sound source minimum.

4. The sound absorbing structure according claim 1, wherein a main component of said first porous member is one of a glass wool and a rock wool, and a main component of said first film is a glass cloth.

5. A soundproof cover comprising a sound absorbing structure disposed on an inner surface of a cover main body, said sound absorbing structure comprising a first structure including:

a first porous member having communicating voids;

a first film having through holes, said first film laminated on a film formation surface of said first porous member for facing a sound source; and a second film having no hole and a ventilation ratio of 100 $cm^3/cm^2/sec$ or more, and laminated on said first film so as to cover an entire surface of said first film, wherein at least one of said through holes of said first film has an opening area of 19 $mm^2$ or more, and the total of said opening area accounts for 1 to 70% with respect to an area of said film formation surface of said first porous member.

6. The soundproof cover according to claim 5, wherein said sound absorbing structure further comprising:

a second structure including:

a second porous member having communicating voids; and a third film having no hole and laminated on at least one surface of said second porous member, and wherein said first structure is laminated on said second structure so that said first and third films faces the sound source.

7. The soundproof cover according to claim 5, wherein a plurality of said first structures are laminated so that said first film faces the sound source, and wherein said first structures are laminated such that the total of said opening area of said through holes of each first structure is successively reduced with that of said first structure disposed closest to the sound source maximum and that of said first structure disposed farthest to the sound source minimum.

8. The soundproof cover according claim 5, wherein a main component of said first porous member is one of a glass wool and a rock wool, and a main component of said first film is a glass cloth.

* * * * *